US006036562A

United States Patent [19]

Brown

[11] Patent Number: 6,036,562

[45] Date of Patent: Mar. 14, 2000

[54] 2-STEP SWIMMER'S SAFETY BELT INFLATABLE INTO A LIFE PRESERVER AND A LIFE VEST

[76] Inventor: Dennis Brown, 1358 Hooper Ave., Suite 240, Toms River, N.J. 08753

[21] Appl. No.: 09/300,780

[22] Filed: Apr. 27, 1999

[51] Int. Cl.[7] ..... B63C 9/08

[52] U.S. Cl. ..... 441/108; 441/113; 441/123

[58] Field of Search ..... 441/94, 108, 111, 441/113, 106, 114, 115, 117, 119, 120, 122, 123

[56] References Cited

U.S. PATENT DOCUMENTS

| | | | |
|---|---|---|---|
| 1,251,394 | 12/1917 | Lyon | 441/113 |
| 5,022,879 | 6/1991 | DiForte | 441/108 |
| 5,180,321 | 1/1993 | Brown | 441/113 |
| 5,368,512 | 11/1994 | Brown | 441/113 |
| 5,393,254 | 2/1995 | Ducheshe | 441/108 |
| 5,702,279 | 12/1997 | Brown | 441/113 |

*Primary Examiner*—Stephen Avila
*Attorney, Agent, or Firm*—Charles I. Brodsky

[57] ABSTRACT

A first belt of the invention—substantially hollow and worn about the waist—is able to be filled with a compressed gas from a cartridge coupled with it so as to unfold and expand outwardly under action of the compressed gas which fills it. A second belt of the invention—also worn about the waist—underlies the first belt and is coupled with it by a drawstrap. When the first belt is filled with the compressed gas, its length increases to form a horizontal tube which serves as a life preserver. Putting it over the head, about the neck and shoulders, and pulling down the end of the drawstrap snugly secures the first belt to the second belt (which continues to be worn about the waist) to convert it to a life vest. Couplings are provided on the first belt for maintaining a circular configuration across the chest area, while an elongated tube allows the wearer to orally inflate the vest should the compressed gas tend to leak over time, in keeping the head of the user out of the water.

14 Claims, 27 Drawing Sheets

2-STEP SWIMMER'S SAFETY BELT INFLATABLE INTO A LIFE PRESERVER AND A LIFE VEST

FIELD OF THE INVENTION

This invention relates to personal flotation devices and, more particularly, to a swimmer's safety belt which can be inflated for use as a life preserver or as a life vest in both a fresh-water and salt-water environment.

BACKGROUND OF THE INVENTION

As is well known and understood, personal flotation devices (PFDs) are available in a variety of shapes, colors and materials.

Typically required for recreation boat use, how many, and what type PFDs are required depends on the number of people on board, the size of the boat, and the kind of boating being done.

As is also known, there presently exist two basic types of PFDs—the inherently buoyant vest of a primarily foam composition, and the fully inflatable type activated by a pulling action which punctures a compressed gas cartridge.

While such devices are typically employed by those on boats—fishing, canoeing and kayaking—a very large market exists for those who do not go near the water at all, either because they cannot swim or are afraid to go into the water, but who could benefit through the use of some type of personal flotation device.

My U.S. Pat. No. 5,180,321, issued Jan. 19, 1993 and entitled "Swimmer's Safety Belt" describes a substantially hollow belt, worn about the waist, and able to assume the shape of a life preserver in use, while allowing the wearer to swim to safety after entering the water, using whatever swim strokes may be convenient. As is there set forth, a compressed gas cartridge is employed to fill the belt in allowing the life preserver so formed to ride up to the wearer's arm level.

My U.S. Pat. No. 5,368,512, issued Nov. 29, 1994 and entitled "Inflatable Swimmer's Safety Belt", on the other hand, went further in describing the use of a pair of belts, tethered together, to restrict the life preserver arrangement to rise up to the wearer's arm level, to hold the wearer vertically in the water—thereby obviating the possibility of the life preserver moving over the shoulders and head of the wearer and somehow possibly coming free. With this feature, a life preserver tube was formed of the first belt, tied to the second belt at a length which prevented the tube from slipping over the shoulders and head, even while still allowing the wearer to be able to swim about.

While the safety belts described in these two patents performed quite well from a safety standpoint, the belt described in my further U.S. Pat. No. 5,702,279, issued Dec. 30, 1997 and entitled "Inflatable Swimmer's Safety Belt, Life Preserver/Life Vest" went even further. The safety belt there described could be arranged either as a life preserver, to allow the wearer to continue to be able to swim about, or could be further converted to a life vest, in holding unconscious wearers face-up in the water—or, for use by non-swimmers or children, and for those who could only swim short distances without tiring, while trying to reach shore or to reach a rescue boat. A pair of belts, tethered together, were again used, with the first—substantially hollow and worn about the waist—being able to be filled with the compressed gas in unfolding and expanding outwardly, and with the second underlying the first on the waist. When the first belt was filled with compressed gas, its length increased to form a horizontal tube riding under the arm pits, in holding the wearer vertically as a life preserver, while allowing the wearer to be able to swim about. Couplings were provided on the first belt for maintaining a circular configuration, all the while permitting the tube to be slid over the arms to the shoulders and neck area in continuing to hold the wearer vertically, but this time, as a life vest, keeping the head of the wearer out of the water. As with my U.S. Pat. No. 5,368,512, the tether of this construction prevented the tube from coming loose from the second, or waist, belt and floating away.

SUMMARY OF THE INVENTION

As will become clear from the following description, the first, inflatable belt of the swimmer's safety belt of this invention again inflates to a life preserver upon actuating the compressed gas cartridge, which can then be fitted over the arms to the shoulders and neck area to form the life vest when being donned. A "drawstrap"—instead of the previously employed tether—is used, however, in keeping the life vest snugly attached and secured to the second jacket belt of the swimmer's safety belt. Besides simplifying the manner by which the safety belt is put on and adjusted, the arrangement described will be appreciated to result in a streamlining of the construction, to the extent that the safety belt, before inflating, could then be readily worn either in the front or back—and, automatically and immediately inflates to the life preserver position once the compressed gas is released, without the wearer doing anything else.

In this manner, an exceedingly comfortable, lightweight, smooth personal floatation device is available, which can be worn simply as a belt, in front or in back, whether in or out of the water, and for hours on end, and of an appearance not very much different from that of an ordinary belt securing one's clothing at the waist. When needed, an included lanyard is simply pulled to puncture the compressed gas cartridge, which automatically inflates the tube as a life preserver, and whose positioning about the arms, shoulders, head and neck as a life vest can be tightened by simple adjustment of the drawstrap which couples the tube to the waist belt for maximum stability.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
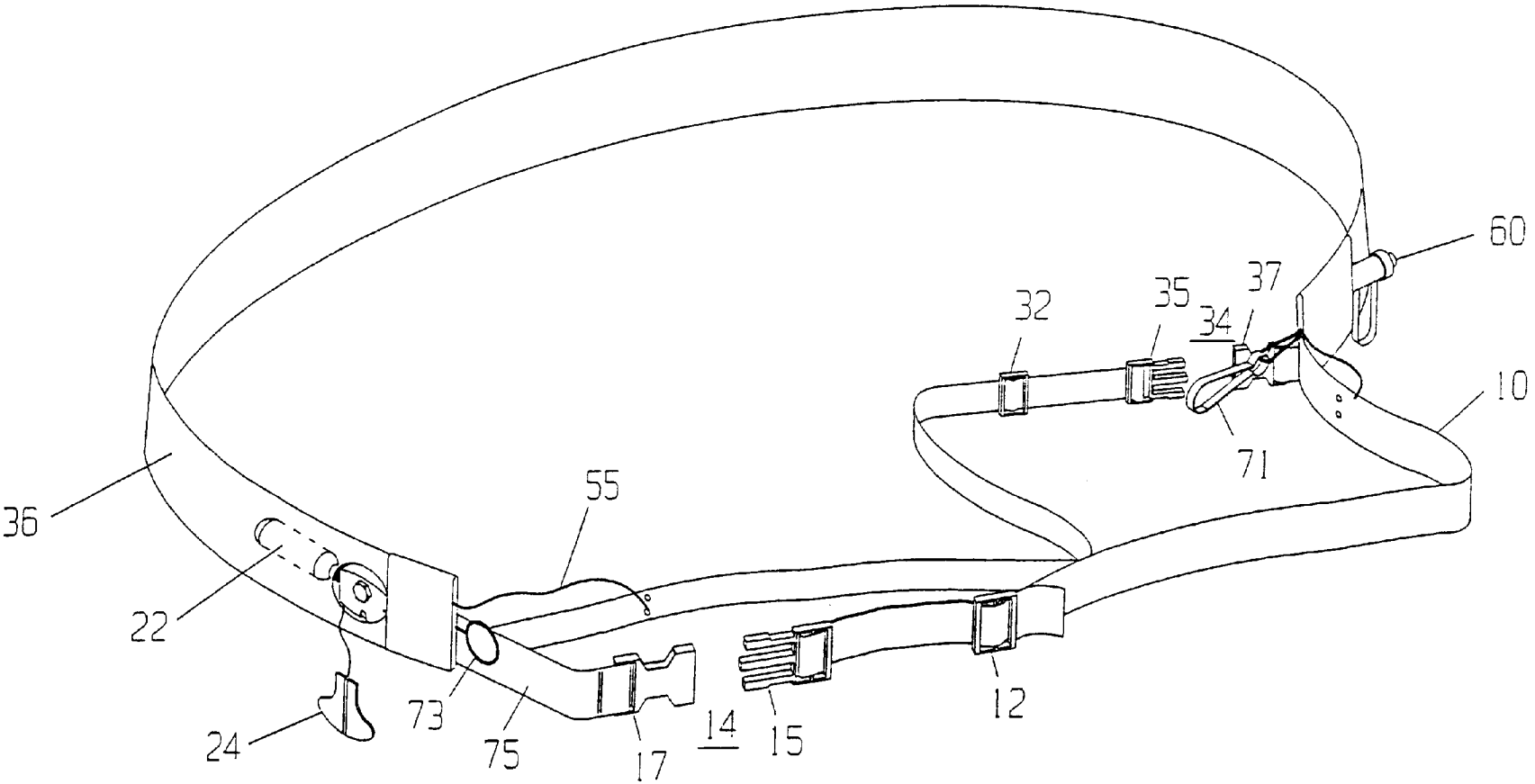
FIG. 1 PRIOR ART
FIGS. 1–4 are perspective views helpful in an understanding of the inflatable swimmer's safety belt of my U.S. Pat. No. 5,702,279, which serves as prior art to the present invention.

Referring to FIGS. 1–4, the prior art inflatable swimmer's safety belt, life preserver/life vest of my U.S. Pat. No.

5,702,279 incorporates a first, substantially hollow belt 10, constructed of a rugged nylon, polyurethane-coated material or similar leak-proof composition, and adjustable in length in any appropriate manner by clip 12, and closable by a releasable lock arrangement, for example, 14. The arrangement of the clip 12 and the releasable lock 14 is such as to enable the size of the belt 10 to be adjusted, i.e., to fit the length of the belt 10 so as to encircle the waist of a wearer. As will be particularly seen from FIG. 2, the belt 10 is provided with foldable, overlapping sections 16 which, when eventually deployed, are pinched-off into separate interconnecting rectangular-like sections 18*a*–18*e* as an illustration (FIG. 3), at predetermined intervals 20 along its length. The releasable lock 14 may be formed of a clasp 15 and a snap-buckle 17, each of conventional design.

Also shown in FIGS. 1–4, as by reference notation 22, is a compressed gas cartridge of a well known type, puncturable by a pin (not shown) movable with respect to the cartridge 22. As will be appreciated, the cartridge 22 is further coupled with the belt so as to discharge its compressed gas when punctured, and so as to fill the belt 10—and its sections 18*a*–18*e*—in the nature of a horizontal tube, similar to a life preserver. A compressed gas cartridge of this type, puncturable by a pin actuator and with a cartridge which can be removably coupled and replaced after use, is shown and described in U.S. Pat. No. 3,754,731. A carbon dioxide compressed gas cartridge 22 may be employed of 25 gram capacity (or even 35 grams), although a smaller cartridge of 16 grams could be utilized instead, to provide the degree of buoyancy required, depending upon whether this type of personal floatation device is to be used in rough, open water on the one hand, or in calm, inland water, on the other hand, as an example.

As with the inflatable swimmer's safety belt of my U.S. Pat. No. 5,368,512, any type of device may be employed to actuate the pin in puncturing the cartridge 22 to discharge its compressed gas. In FIGS. 1–4, as an illustration, a lanyard 24 may be "jerked" to cause the pin movement to puncture the cartridge 22, as described in U.S. Pat. No. 3,754,731.

The belt 10 may then be worn by a swimmer, or simply as a safety belt by an occupant of a water craft, and when adjusted for comfort and size by the clip 12 (or by any other type of clip and lock arrangement 14), closes to fit the waist of the wearer, with the compressed gas cartridge 22 then sealed. If the swimmer wearing such belt then finds himself or herself in difficulty in the water—or if the occupant of the water craft, boat, canoe, or kayak wearing such belt inadvertently falls out into the water—the lanyard 24 can be "jerked" accordingly, so as to cause the puncture of the cartridge 22 and the automatic filling of the hollow belt 10 and its sections 18*a*–18*e* as a life preserver tube. In this manner, the belt 10 and its component parts comprise an inflatable belt which inflates into a life preserver when the compressed gas cartridge 22 is activated.

Figure 2:
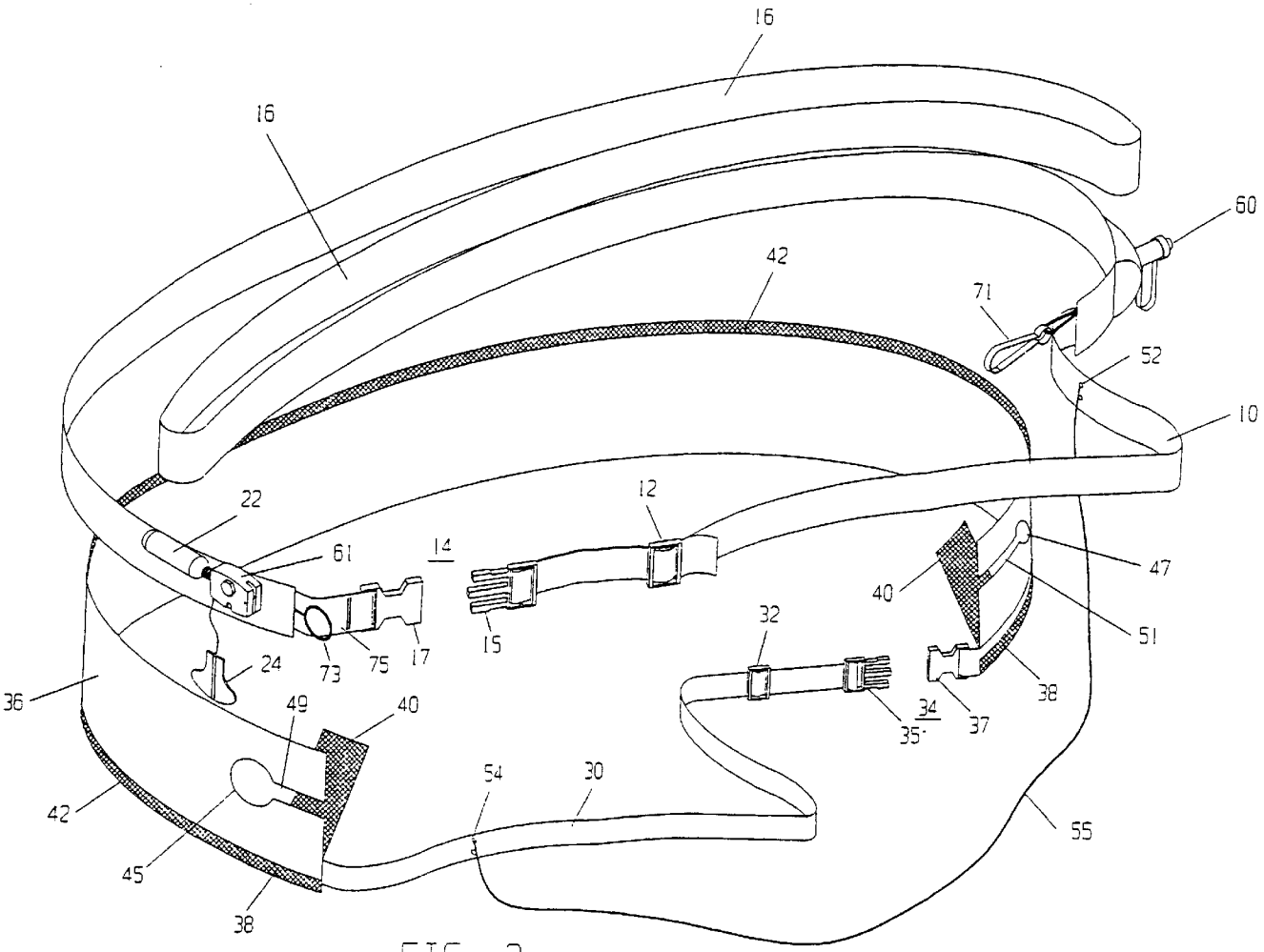
FIG. 2 PRIOR ART
Figure 3:
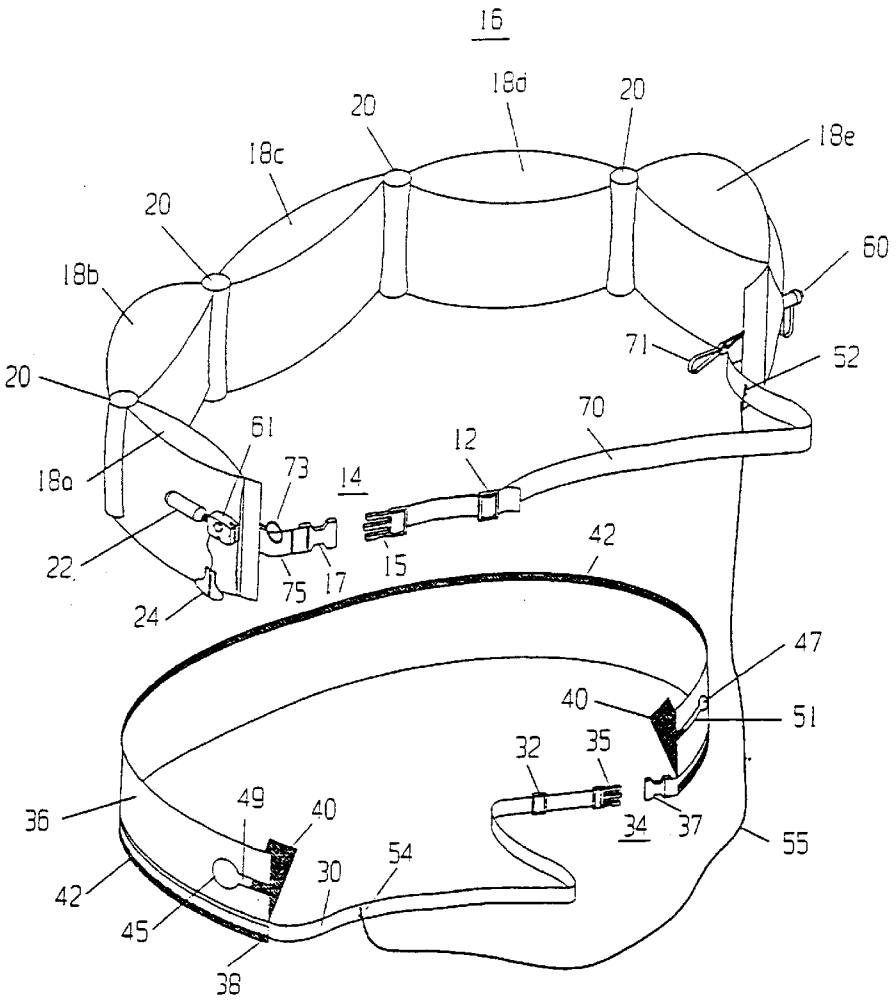
FIG. 3 PRIOR ART
Figure 4:
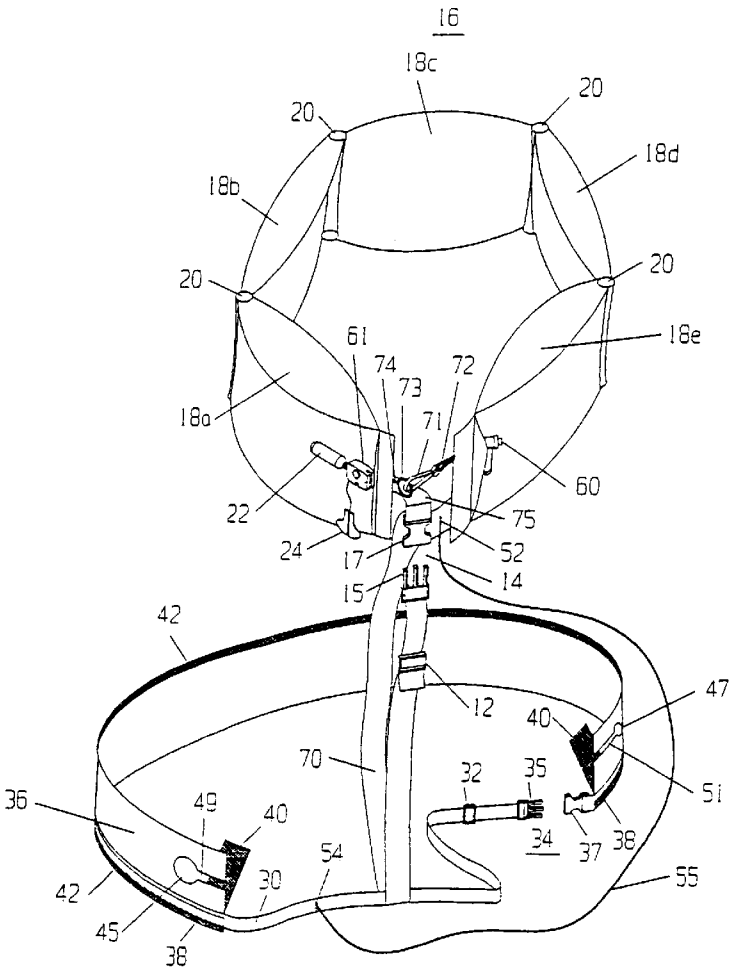
FIG. 4 PRIOR ART

In accordance with the teachings of my U.S. Pat. No. 5,702,279, a second belt 30 is also provided, similarly constructed of a rugged nylon, polyurethane-coated material or similar leak-proof composition, adjustable in length in any appropriate manner, as by the clip 32 and releasable lock 34 to encircle the waist of the wearer. This second belt 30 is of a conventional construction to be worn about the waist, underlying the first belt 10, and contradistinct therefrom in not being hollow, or sectionalized as at 18*a*–18*e*. Moreover, and as illustrated in FIGS. 2, 3 and 4 herein, this "conventional" belt 30 forms part of a jacket 36 which fits about the waist of the wearer and within which the overlapping folds 16 of the first belt are temporarily enclosed and secured (FIG. 1). To such end, and as shown in FIGS. 2, 3 and 4, the ends of the second, underlying belt 30 are fixedly secured at 38—as by a "tacking"—and including a Velcro or other adhesive fastener 40 in temporarily holding the folded section 16 of the belt 10 in place prior to deployment, in which event the unfilled sections 18*a*–18*e* are enclosed within the jacket 36, and hidden from sight. Reference notation 42 in FIGS. 2, 3 and 4 will be understood to be separate Velcro, or other adhesive securements, to wrap-over and enclose the sections 18*a*–18*e* within the jacket 36, before the puncture of the compressed gas cartridge 22. As with the releasable lock 14, associated with the first belt 10, the releasable lock 34 associated with the second belt 30 may be formed of a clasp 35 and a snap-buckle 37 of conventional design.

The inflatable swimmer's safety belt, life preserver/life vest will thus be appreciated to take on the appearance of FIG. 1 prior to actuation, wherein the first belt 10 overlies the second belt 30 about the waist of the wearer, and with the temporarily secured folded, overlapping unfilled sections 18*a*–18*e* enclosed within the jacket 36. In this respect, the second belt 30 will be understood to be a part of the jacket 36 in which the "inflatable belt" 10 is packed prior to use, and into which the "inflatable belt" is re-packed after it is deflated.

Reference notation 60 in FIGS. 1–4 comprises a removable cap and nipple-type tube which permits the release of the compressed gas from the sections 18*a*–18*e* when it is desired to deflate the belt 10 for repacking into the jacket 36 after use, or to manually fill the sections by wearer's breath, as where the sections 18a-18e may tend to lose $CO_2$ gas or air in the event that the inflatable swimmer's safety belt is worn in the water for a prolonged period of time. At the same time, the jacket 36 is provided with a pair of holes 45 and 47, with adjacent slits 49 and 51, which allow the jacket 36 to freely break open when the belt 10 is to be inflated and deployed. The holes 45 and 47—together with their respective slits 49 and 51—will also be seen to accommodate the compressed gas actuator 61 controllable by the lanyard jerk 24 and the removable cap 60, respectively (see FIG. 1).

In operation, upon jerking of the lanyard 24, the compressed gas cartridge 22 not only fills the belt 10 and/or its sections 18*a*–18*e*, but also acts to unfold and expand outwardly the folded-over rectangular-like sections 18*a*–18*e*, previously held within the jacket 36. More specifically, the filling by the compressed gas which is released will be seen to unfurl the Velcro sections 40 and 42, so as to increase the length of the belt 10, to free it from the enveloping confines of the jacket 36, and to form the life preserver of increased length which results, so as to permit the belt 10 to raise over the chest area towards the wearer's arm pit level—done automatically as the inflated sections 18*a*–18*e* ride up in the water. Depending upon the amount of the hollow belt 10 initially overlapped, and on the amount of the belt 10 devoted to receive the inflating gas, the unfolding and outward expansion of the belt 10 can be predetermined, to allow the belt 10 to ride under the armpits of the wearer, and to thereby hold the wearer substantially vertical in the water. In a preferred embodiment of the arrangement described in my U.S. Pat. No. 5,702,279, the overlapping belt portions 18*a*–18*e* were selected so that with a carbon dioxide compressed gas cartridge 22, the length of the belt 10, when filled, increased by approximately 10 inches, to allow the belt 10 to rise to the armpits of the wearer, from its initial position at the wearer's waist.

Further, and in accordance with the teachings of U.S. Pat. No. 5,702,279, a tether is included between an underside surface of the overlying belt 10 (as at 52) and a topside surface of the underlying belt 30 (as at 54). Such tether, identified by the reference notation 55 in FIGS. 1–4, is selected of a length to restrict the upward riding of the belt 10 when expanded. In such manner, the tube so formed is prevented from riding over the shoulders and/or the head of the user, to become otherwise "free". The inflatable swimmer's safety belt of U.S. Pat. No. 5,702,279 could then be used as a life preserver.

In accordance with the teachings of my U.S. Pat. No. 5,702,279, the arrangement of FIGS. 1–4 can also be employed to convert the life preserver thus so formed into a life vest for those situations where needed. In FIGS. 3 and 4, in particular, the lock 14 of the first belt 10 can be released, and its strap 70 coupled over and under, about the belt 30—vertically—to then be closed again and tightened through the clip 12 to maintain constant the distance between the belt 30 and the then re-joined lock 14. Means are provided, at the same time, on the inflated belt 16, to essentially maintain the life preserver shape formed when the inflated belt 16 is secured through the horizontal closing of the lock 14, in the manner shown in FIG. 3. Such configuration can be maintained through releasable couplings provided adjacent the opposite ends of the inflated belt 16, as by a snap-hook 71 secured to the belt 16, at an underside 72 overlapped by the strap 70. In like manner, a ring 73 can be secured at an opposite underside 74, beneath the closure end of the strap 75 where the lock 14 is secured. In such manner, as shown in FIG. 4 then, the life preserver previously formed by the sections 18*a*–18*e* can be raised above the armpits of the wearer, but restricted to the shoulder and neck area by the strap 70, 75 in holding the inflated sections about the neck.

Further reference should be had to my U.S. Pat. No. 5,702,279 in understanding the specific manner in which the life preserver of the inflatable swimmer's safety belt of FIGS. 1–4 is converted to the life vest to support an unconscious or overly tired wearer. Similar reference should be had for understanding how, when the wearer's strength is regained, the conversion can be reversed back from the "life vest position" to the "life preserver position", so as to allow the wearer to begin swimming anew, until tiring later on, to convert the inflatable swimmer's safety belt back to the "life vest position", etc. A reference to FIGS. 11–18 of that patent are quite helpful in this respect.

Figure 5:
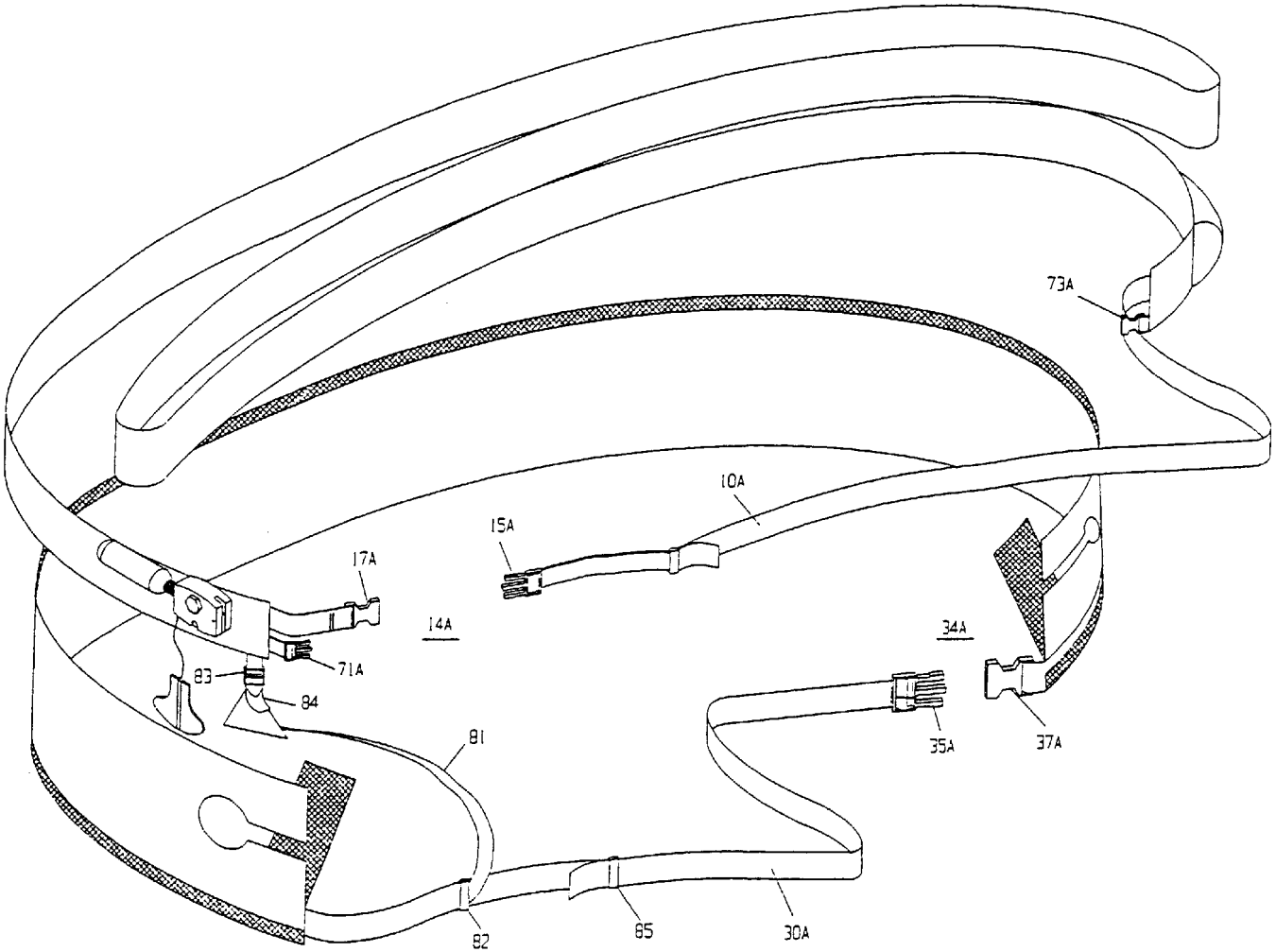
FIGS. 5 and 6 are perspective views showing the modifications made which lead to the preferred embodiments of this invention.
Figure 6:
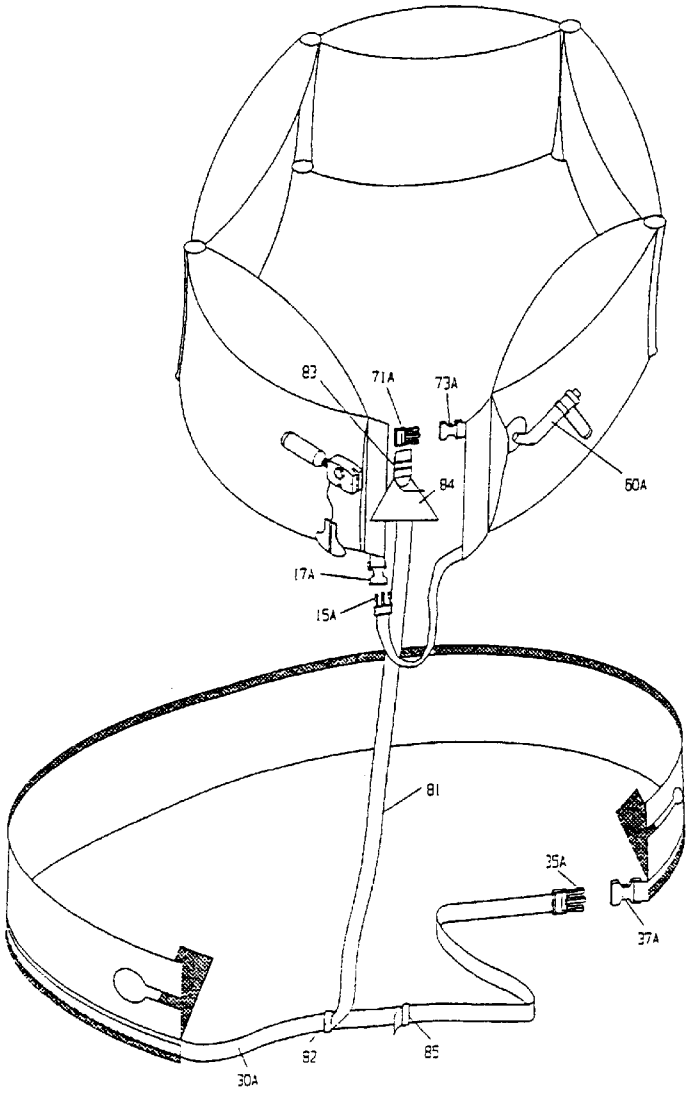

FIGS. 5 and 6 are perspective views helpful in an understanding of the modifications of the present invention, which simplifies the manner by which the swimmer's safety belt of U.S. Pat. No. 5,702,279 is put on by the wearer, and in streamlining the repacking of the belt after it has been used. More specifically, FIG. 5 will be seen to be a modification of the prior art construction of FIG. 2, while FIG. 6 is a modification of that shown in FIG. 4. Particularly suited for swimmers who get caught in riptides or get a cramp while swimming and primarily need just a quick-rescue floatation ring to get them back to shore (the conversion capability from the "life preserver position" to the "life vest position" being a desirable and important further protective feature), the 2-step swimmer's safety belt changes include the following:

a. In the arrangement of FIG. 2, the releasable clasp 15 and snap-buckle 17 employed with the overlying belt 10, and the releasable clasp 35 and snap-buckle 37 employed with the underlying belt 30, were all of the same size. It has been found advantageous to differentiate the two belts employed, and their locking arrangements, as an aid to the wearer in putting on the inflatable swimmer's safety belt of this type. In the preferred embodiments of FIGS. 5 and 6, the differentiation is attained by "highlighting" the releasable lock 34 on the belt 30, as compared to the releasable lock 14 on the belt 10. In accordance with this preferred embodiment, the releasable clasp 35A, the snap-buckle 37A and the belt 30A are much thicker and larger than the releasable clasp 15A, the snap-buckle 17A and the belt 10A. This makes the donning of the safety belt of the invention much simpler, by identifying the larger lock 34A to be the first choice in placement, and then following with the later, smaller lock 14A. Any confusion that might otherwise exist is also eased through the realization which follows from placing the smaller lock 14A over the larger lock 34A when layering the two belts as before, as the more normal way of securing things together.

b. In the embodiments of FIGS. 5 and 6, the snap-hook 71 and the ring 73 of the prior art construction of FIG. 2 (which are joined together when the life vest is to be secured about the wearer's neck, and then released when the vest is to be taken off after use) have been replaced by a lock arrangement, including a snap-buckle 73A and a clasp 71A. Such change has similarly been found to make matters easier, especially when parts are wet (as in the water), where the snap-hook 71 of FIG. 2 has a tendency to slip and slide about the ring 73 in joining them, and where a measured amount of manual force and dexterity is required to work the securement and later, the release.

c. The nipple-type tube of the prior art FIG. 4, through which a wearer could blow to inflate the belt with breath air (in the event the compressed air leaks or the belt otherwise deflates), is replaced in FIG. 6 by a much longer tube 60A, again to simplify use.

d. Additionally, the tether 55 of the prior art construction of FIGS. 2 and 4 (which extends between the underside surface of the overlying belt 10 at 52 and the topside surface of the underlying belt 30 at 54) is replaced entirely by a drawstrap configuration. As shown in FIGS. 5 and 6, this drawstrap 81 is coupled to the belt 30A by a movable box slide 82. Secured to the belt 10A is a lock slide 83 through which the drawstrap 81 passes, with a tab extension 84 on the drawstrap 81 which is pulled downward for drawing the belt 10A towards the belt 30A until snug to the wearer, and to lock the drawstrap 81 in place. Highlighting the tab end 84 (in "orange", for example) easily identifies where the wearer is to pull—and enables this construction to simplify the manner of converting the life preserver arrangement of my U.S. Pat. No. 5,702,279 design into the life vest arrangement here. More specifically, instead of having to unsnap the clasp 15 (in FIG. 4), pulling the strap 70 down, under and around the belt 30 and up again, resnapping it back together and then adjusting the strap to size by the clip 12, all that becomes necessary with the preferred embodiments of FIGS. 5 and 6 is to simply draw down on the tab extension 84 until the drawstrap 81 is snug.

The last 5 steps described in my U.S. Pat. No. 5,702,279 to convert the "life preserver" to a "life vest" are thus effectively eliminated. At the same time, the tether 55 that secures the first inflatable belt 16 to the second jacket belt 30 has been replaced by the drawstrap 81, with the drawstrap serving to retain this function automatically.

e. The lanyard 24 will also be understood to be highlighted in color—for instance "red"—to identify where the user is to first pull, in deploying the construction.

f. Lastly, the clip 32 of FIG. 2 is replaced by a second box slide, 85 (FIG. 5), to allow for easier dimensioning of the belt 30A for wearing, and to allow adjustment so that the belt 30A can be worn in the front or in the back.

After use, the 2-step inflatable swimmer's safety belt of this improvement may be packed in manner substantially the same as that of my U.S. Pat. No. 5,702,279 manufacture. In so doing, the compressed gas cartridge 22 continues to extend from one end, with the oral inflater tube 60A being at the opposite end. Resort should be had to this patent, and particularly FIGS. 20–25, for an understanding of the folding pattern which permits the repacking. However, as a result of the modifications set forth herein, a greater streamlining of the package results, to the extent that the belt which results could be worn either in the front, or in the back—and will inflate upon pulling the lanyard 24 in substantially the same manner. Whether the sections formed upon filling the belt be rectangularly shaped, as in FIGS. 1–4, or whether they be elongated, oblong, or of an oval configuration, the filling to a "life-preserver" configuration first, will follow, to be then converted in a second step to the "life vest" configuration when and where needed, and when the inflatable belt is deflated for packing and re-use, this rectangular or elongated, oblong or oval shape of the inflatable belt lends itself to be readily folded in half, and then into quarters and so on if necessary until it fits compactly and exactly into the second jacket belt.

Where primarily intended for swimmers, in relatively calm water, only a 16 gram amount or so of compressed gas buoyancy will be required, but where the possibility that the swimmer may engage rougher water—or be in it for a considerable period of time or becomes incapacitated—, a greater degree of buoyancy (in the order of 25 grams or so), could warrant the use of a larger capacity compressed gas cartridge. In either event, and as will be appreciated, any degree of buoyancy could be selected for the cartridge employed, depending upon intended use, and the conditions reasonably anticipated by the swimmer.

Again, as with the inflatable belt of my U.S. Pat. No. 5,702,279 construction, once in the water, all the wearer has to do is to pull on the lanyard 24, and the belt 10A automatically inflates into the life preserver position, allowing the wearer to swim about. With the conversion into the life vest, a tiring swimmer could remain afloat, especially with the lock arrangement provided by the clasp 71A and the snap-buckle 73A maintaining the inflated belt 10A across the chest area, and with the buoyancy of the compressed keeping the wearer's head out of the water. In this respect, it will be appreciated that the releasable lock 14A of FIGS. 5 and 6 serves to maintain the circular configuration of the inflating tube secured about the waist by the drawstrap 81, whether the swimmer's safety belt originally be worn in the front or in the back. As will be appreciated, the drawstrap 81 is selected of a sufficient length to allow the inflated belt 10A to be placed in position over and about the neck, before being drawn down and tightened for snugness. And, with the box slide 85, the waist belt 30A, if originally worn in the back, can easily be oriented to the front of the wearer, as in FIG. 6. With the movable box slide 82 anchoring the drawstrap 81, the drawstrap 81 can be rotated 360° vertically and oriented to its desired position—in the front of the wearer—even where the waist belt 30A is worn behind.

Figure 7:
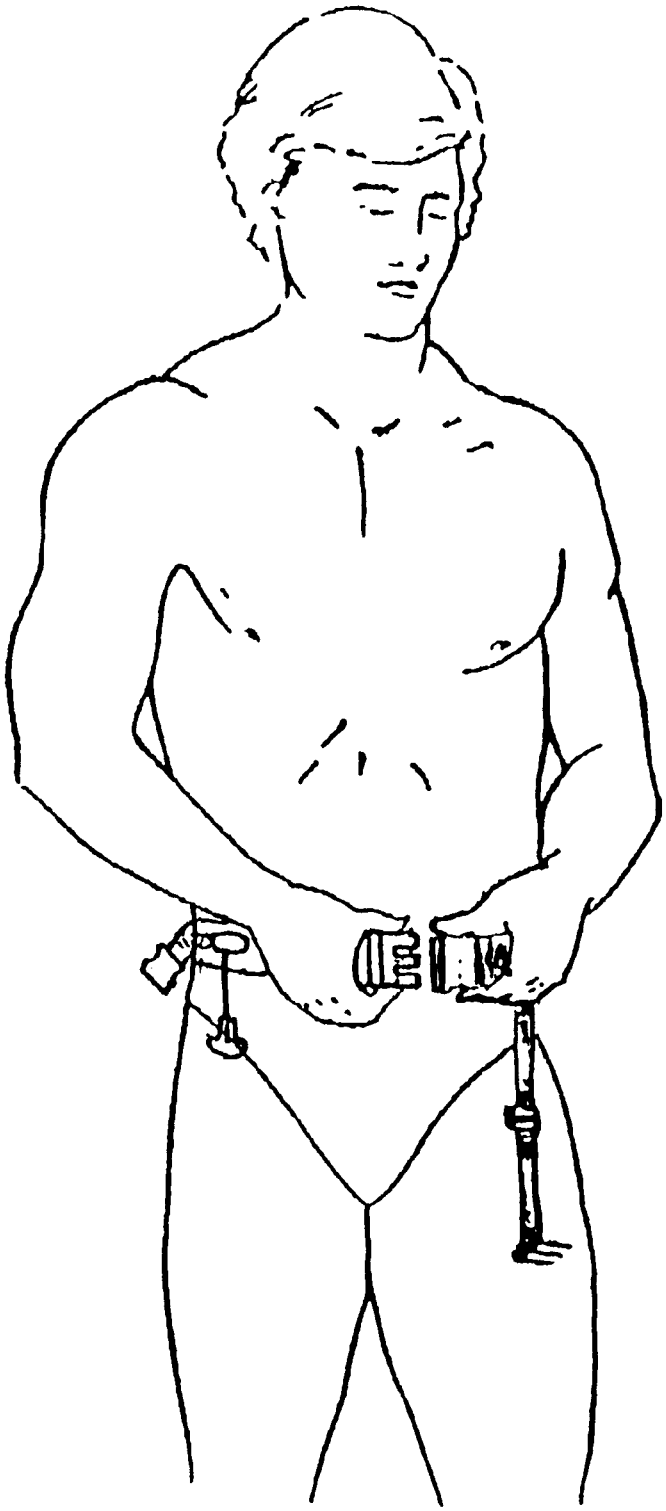
FIGS. 7–17 are illustrations helpful in understanding the manner of using the safety belt of the present invention, showing the modifications made which lead to the preferred embodiment described.
Figure 8:
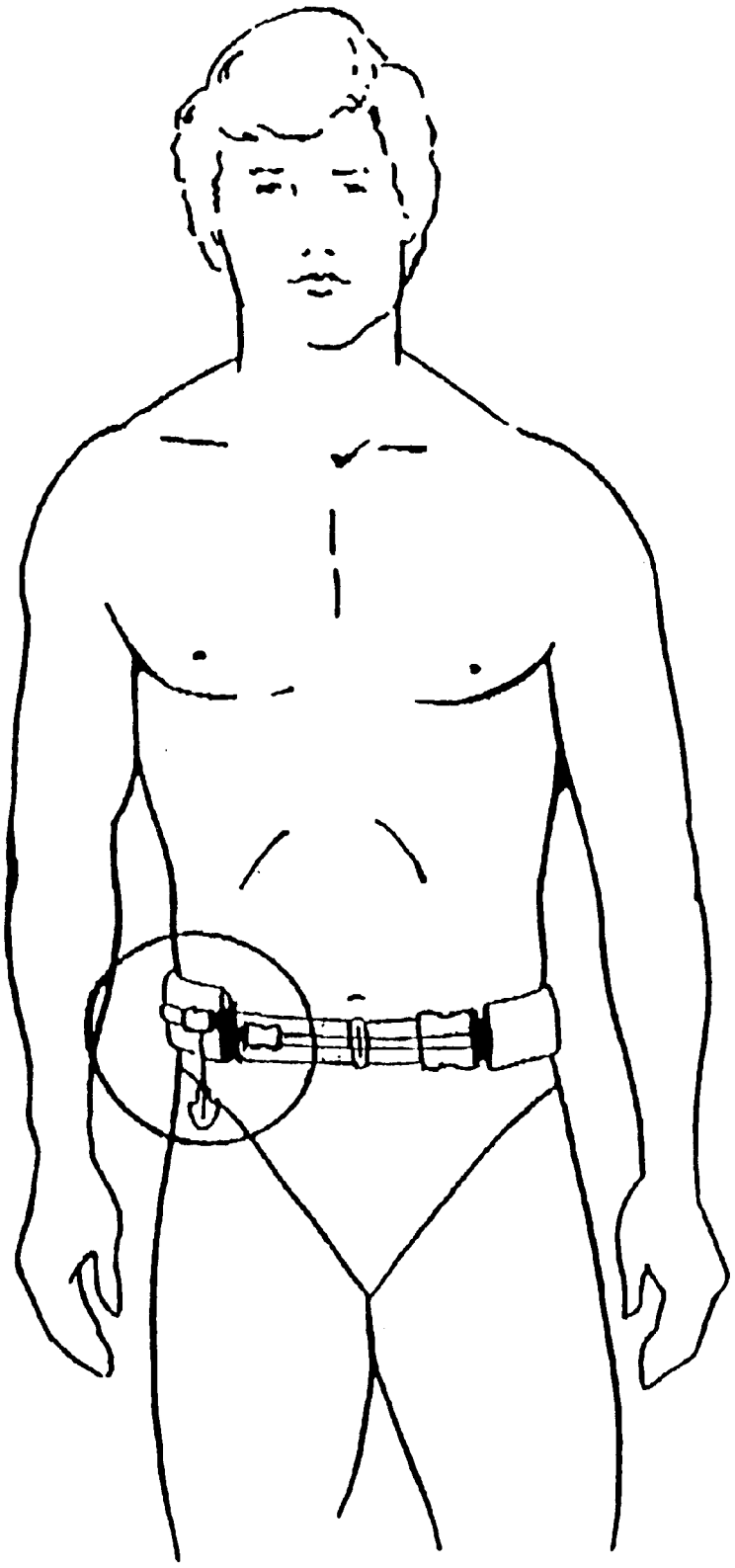
Figure 9:
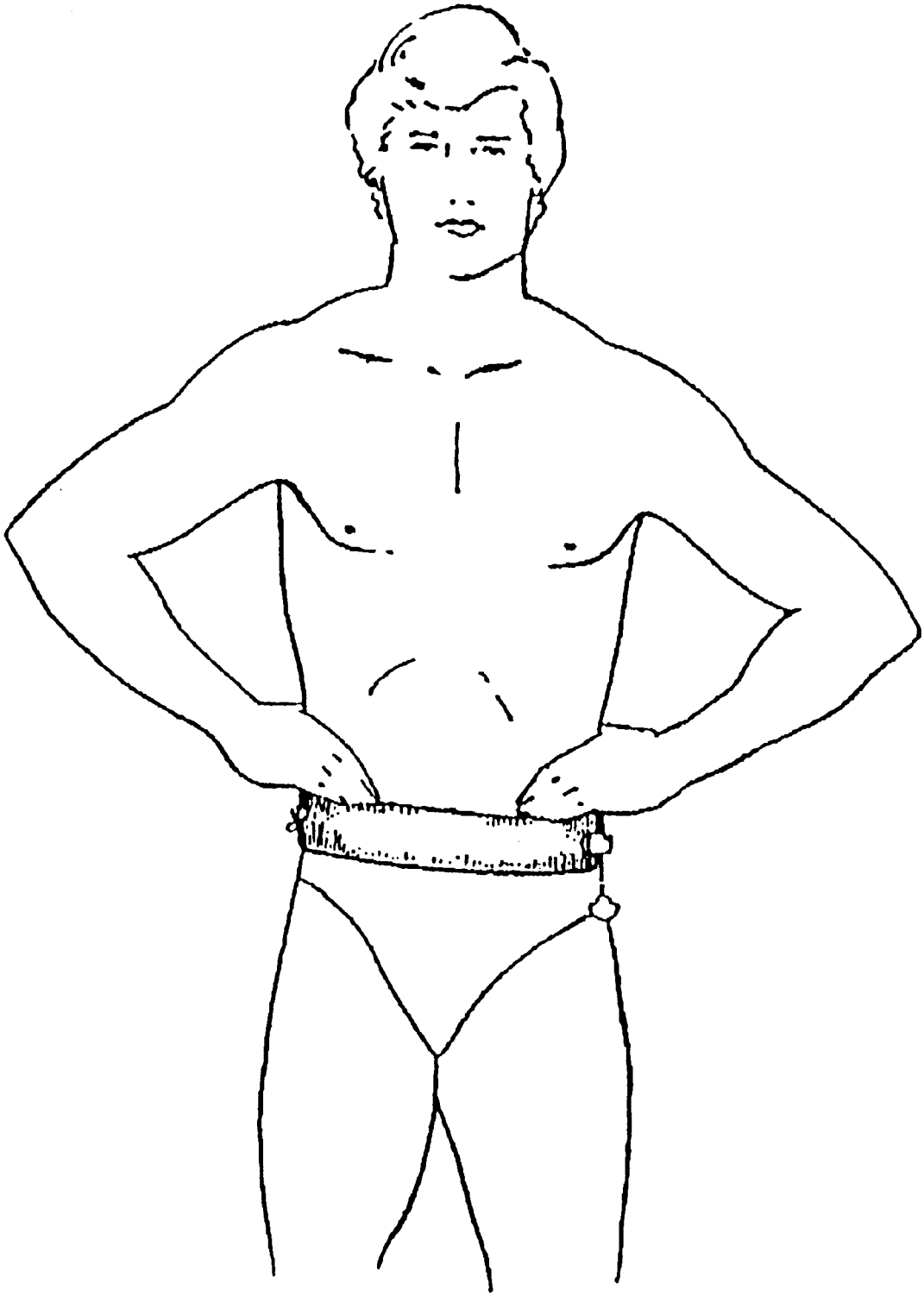
Figure 10:
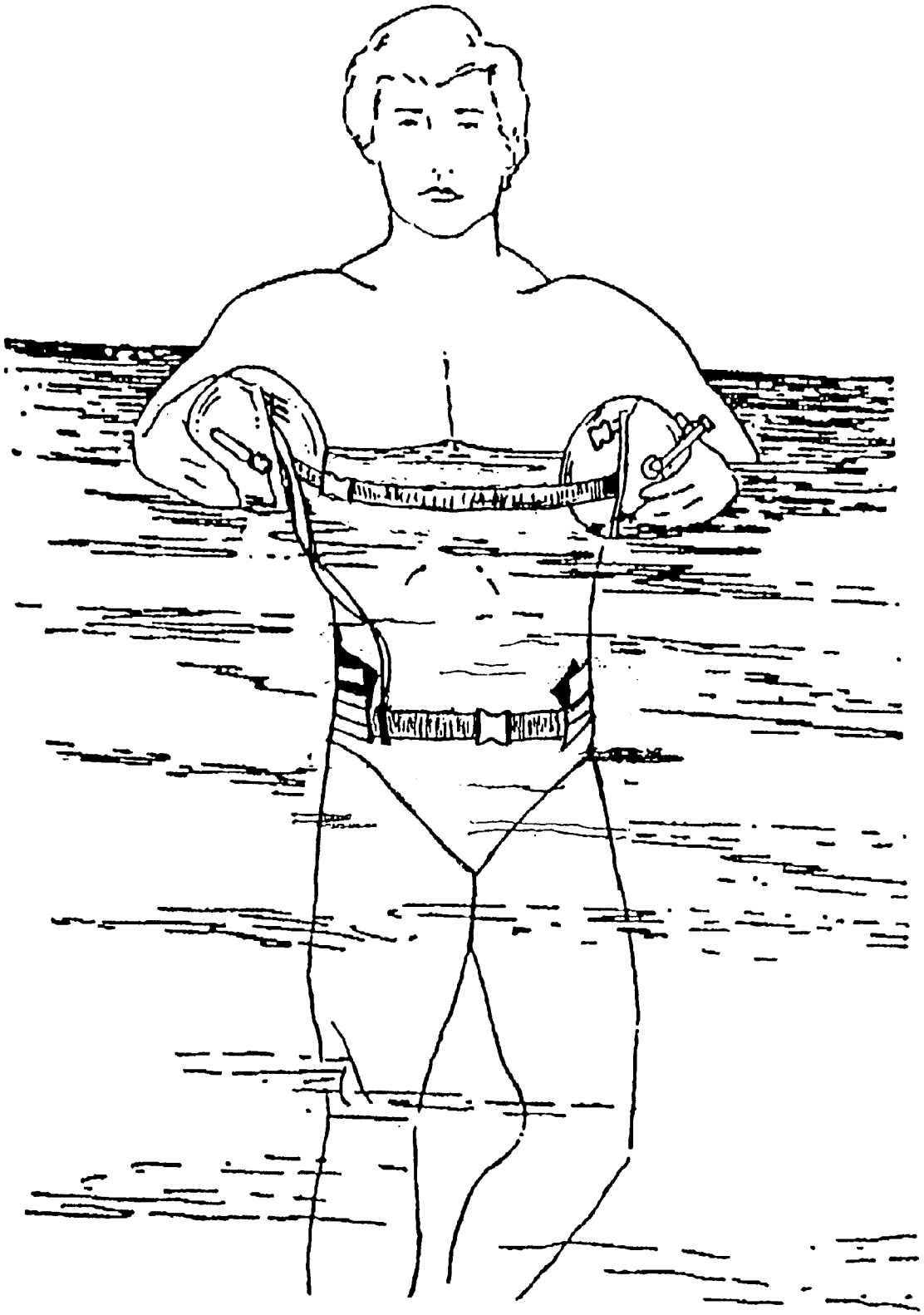
Figure 11:
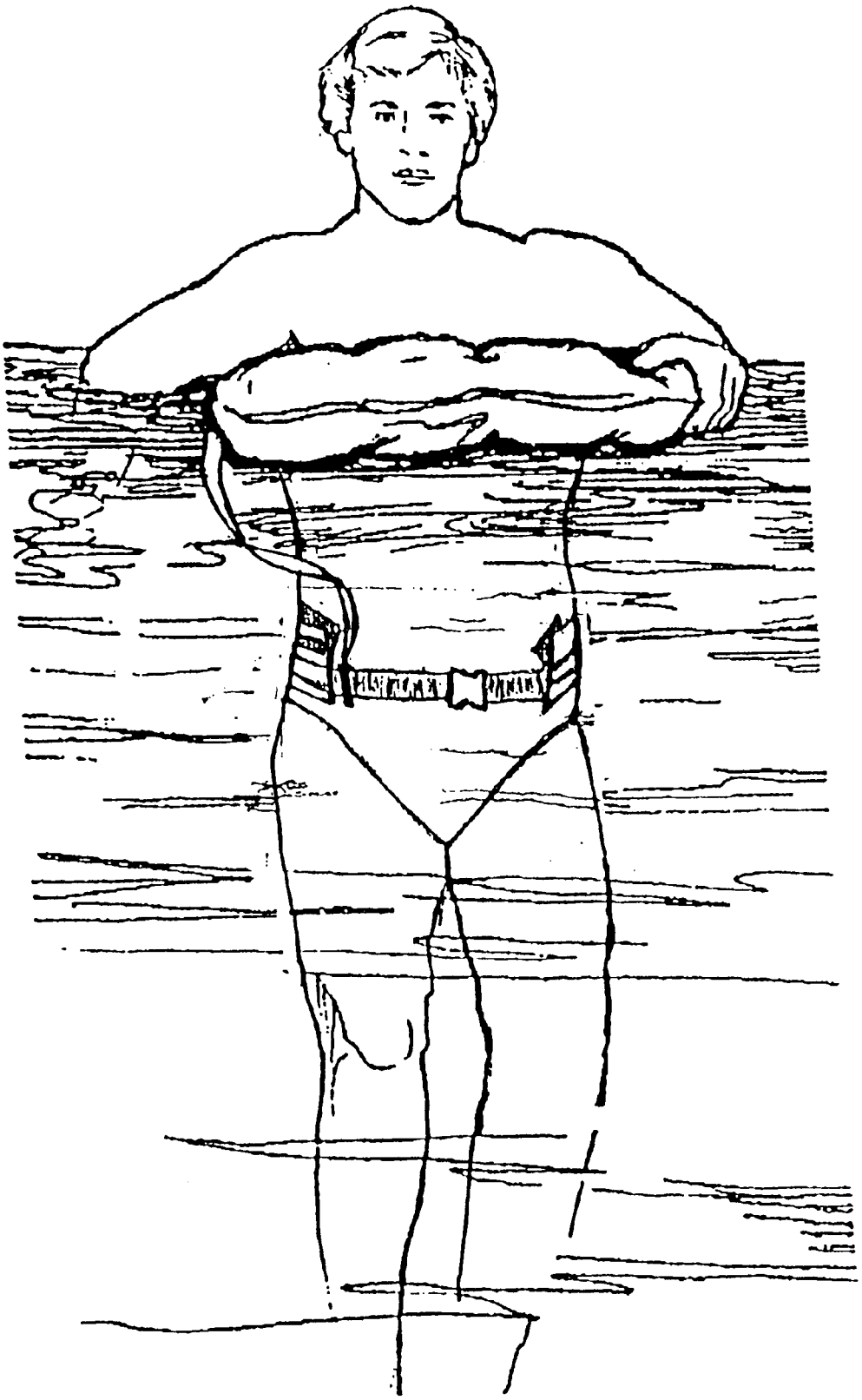
Figure 12:
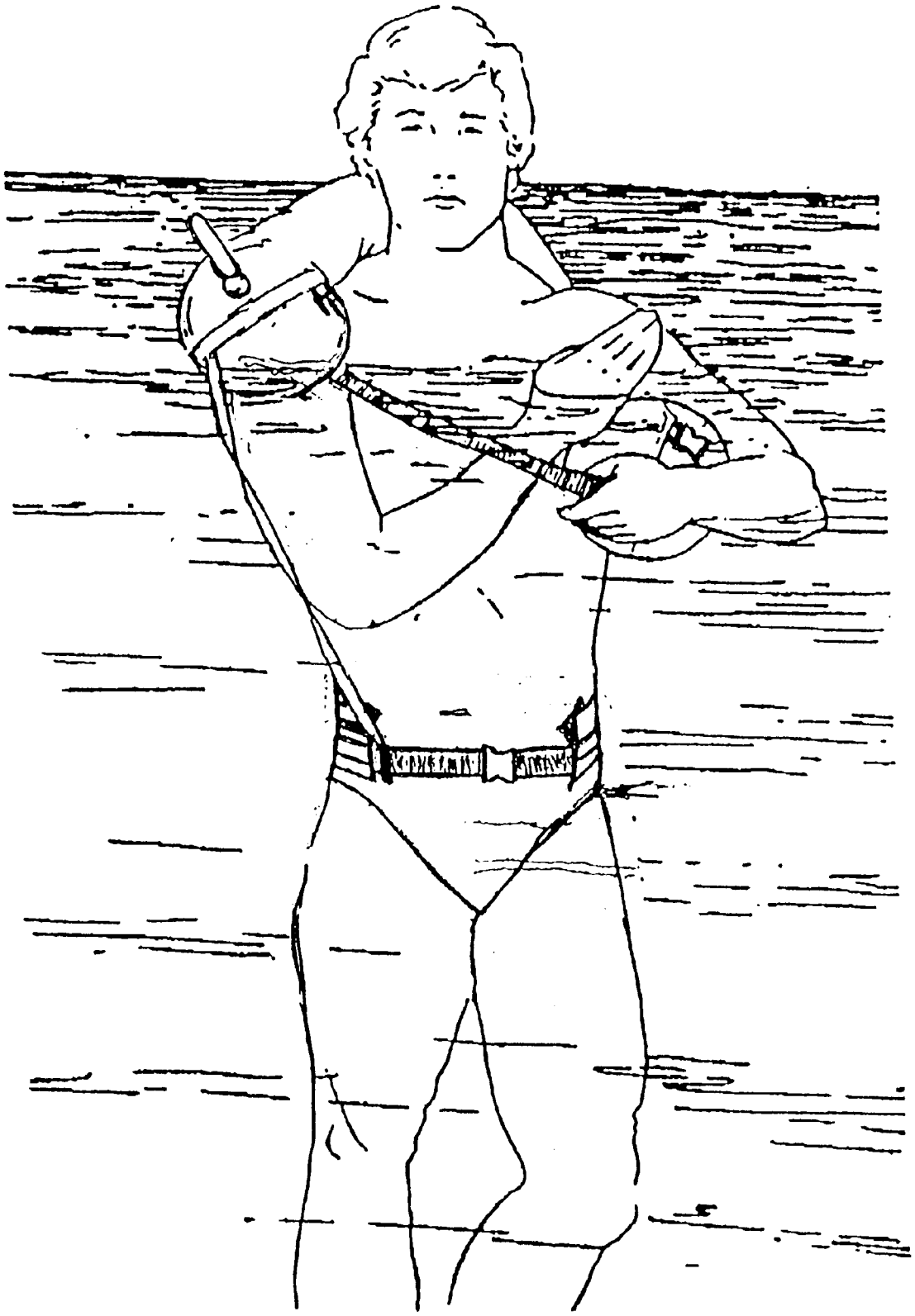
Figure 13:
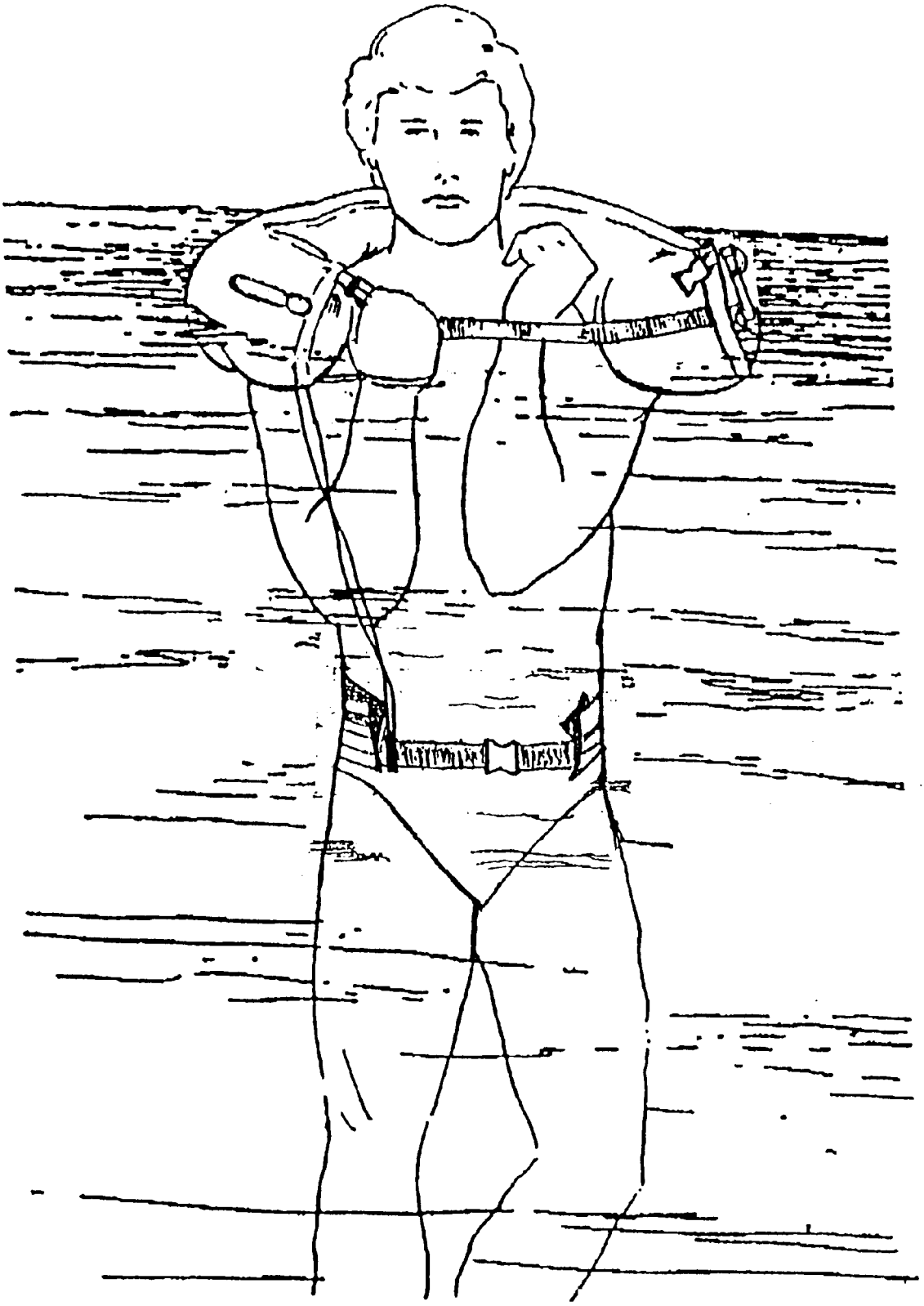

FIGS. 7–27 illustrate the manner of using the 2-step swimmer's safety belt of this invention. In FIG. 7, the larger belt 30A is adjusted to size by the clip 35A and closed by the snap-buckle 37A. FIG. 8 follows from adjusting the smaller belt 10A to size by the clip 15A and the snap buckle 17A, so that the lanyard 24 hangs down freely. Rotating the belts 30A and 10A to the back, as shown in FIG. 9, then allows the wearer to swim freely about, just as in my previously mentioned patent. (As will be understood, however, the belts 30A and 10A can also be oriented to the front, rather than to the back, to allow ease of swimming.) If the wearer tires while swimming, or if the belt combination is worn by a non-swimmer who accidentally falls into the water, the lanyard 24 is jerked down sharply, and the belt 10A and its folded-over sections 18*a*–18*e* instantly inflate to the position shown in FIG. 10, where the life preserver inflates over the chest and under the arms for maximum stability. To rest in the water in this way, the wearer rotates it either to the back (FIG. 10) or to the front (FIG. 11). In either situation, the safety belt allows the person to swim freely, and if the wearer then tires, the belt may be rotated back to the initial position, to be slid up to the armpit level for rest.

However, and as noted previously, situations arise where a wearer can excessively tire after swimming with the belt of the invention in this, its "life preserver" position, or where the wearer tends toward unconsciousness—in those instances, it becomes necessary to keep these wearers face up in the water. In accordance with this present invention, however, the inflatable swimmer's safety belt is convertible from its "life preserver position" to a "life vest position" in affording maximum safety. To attain this, and as now will be described, the strap of the belt 10A is utilized in a different manner to anchor the "inflatable belt" 16 to the "jacket belt" 36 which remains around the wearer's waist when the life preserver inflates.

Figure 14:
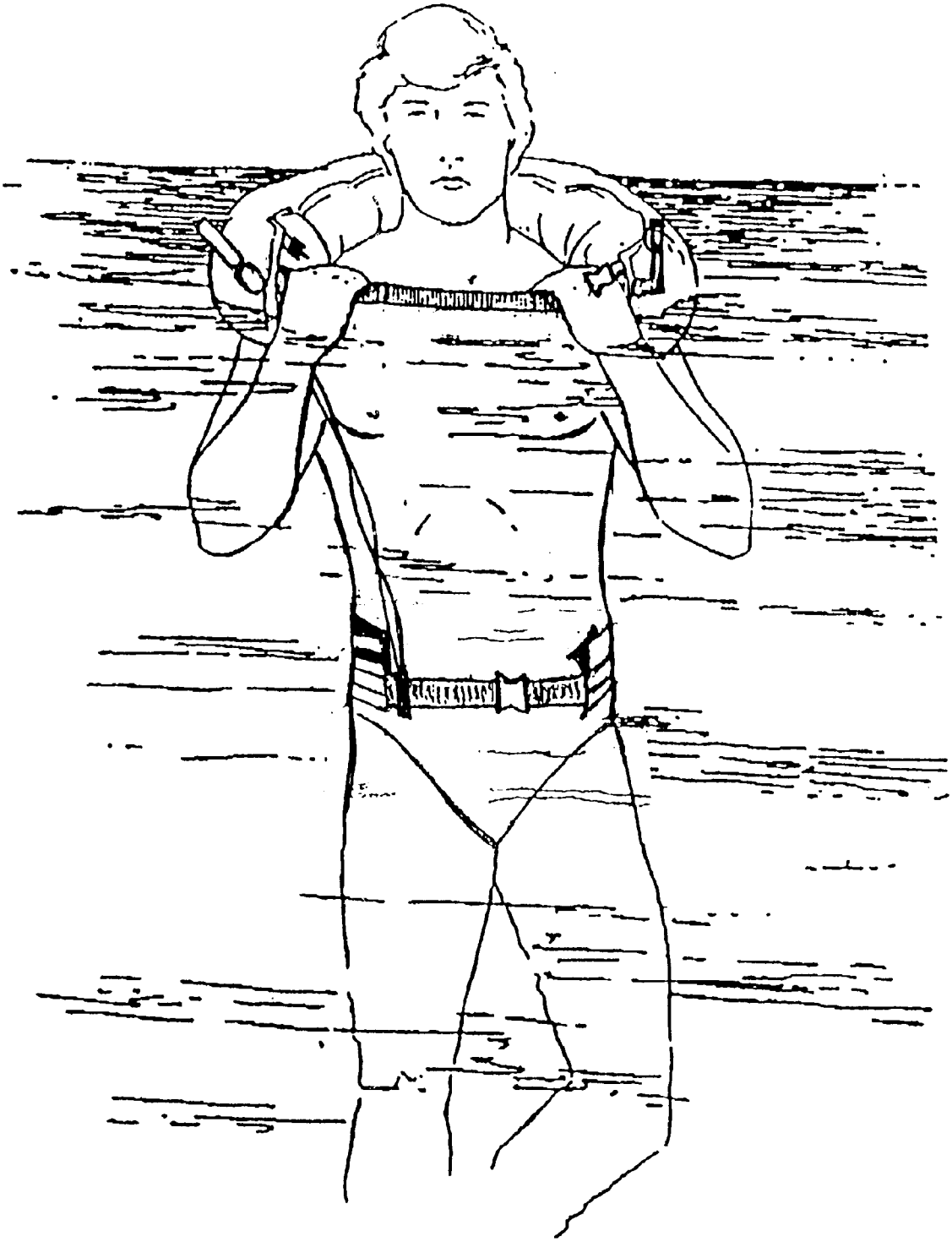
Figure 15:
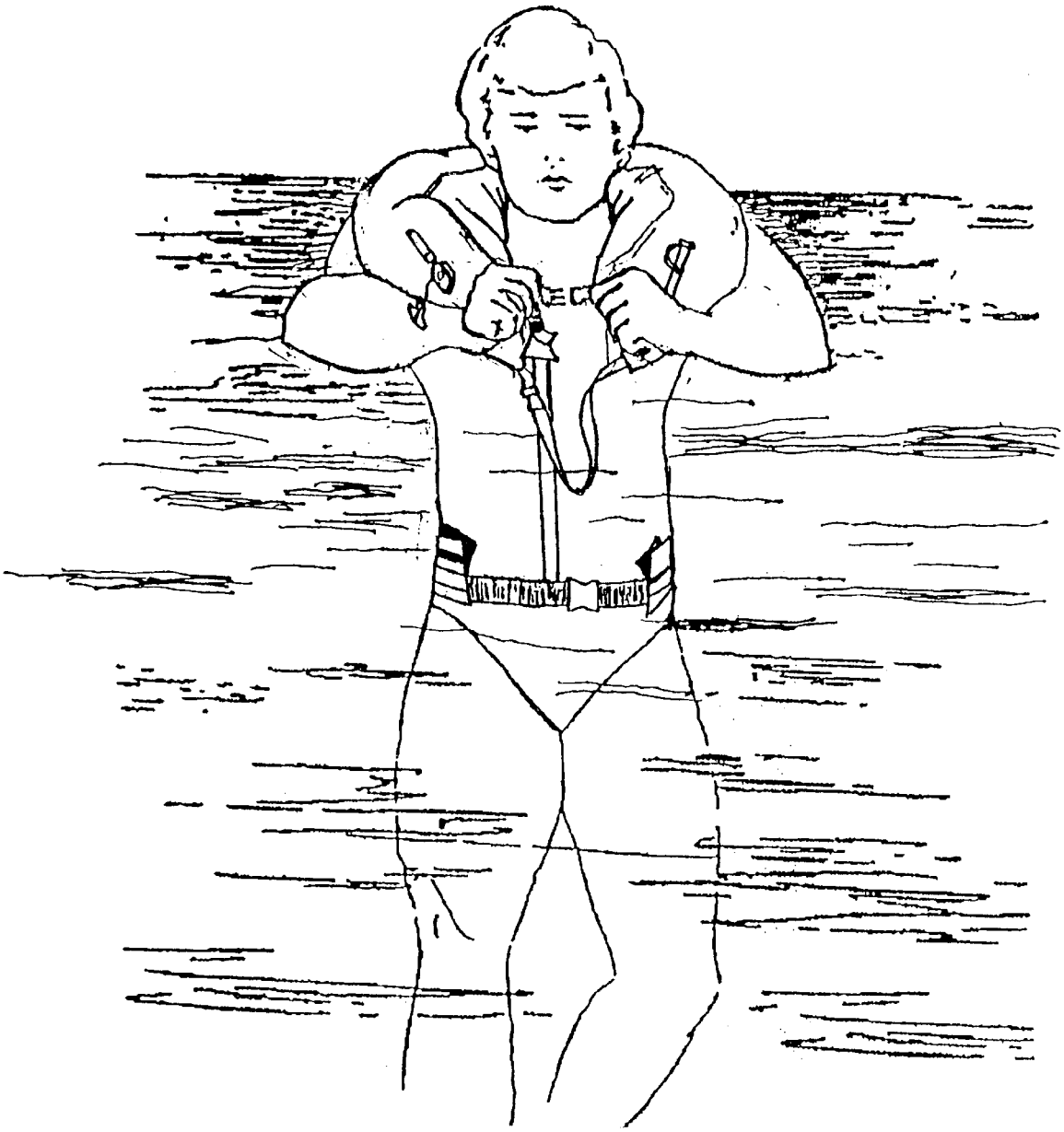
Figure 16:
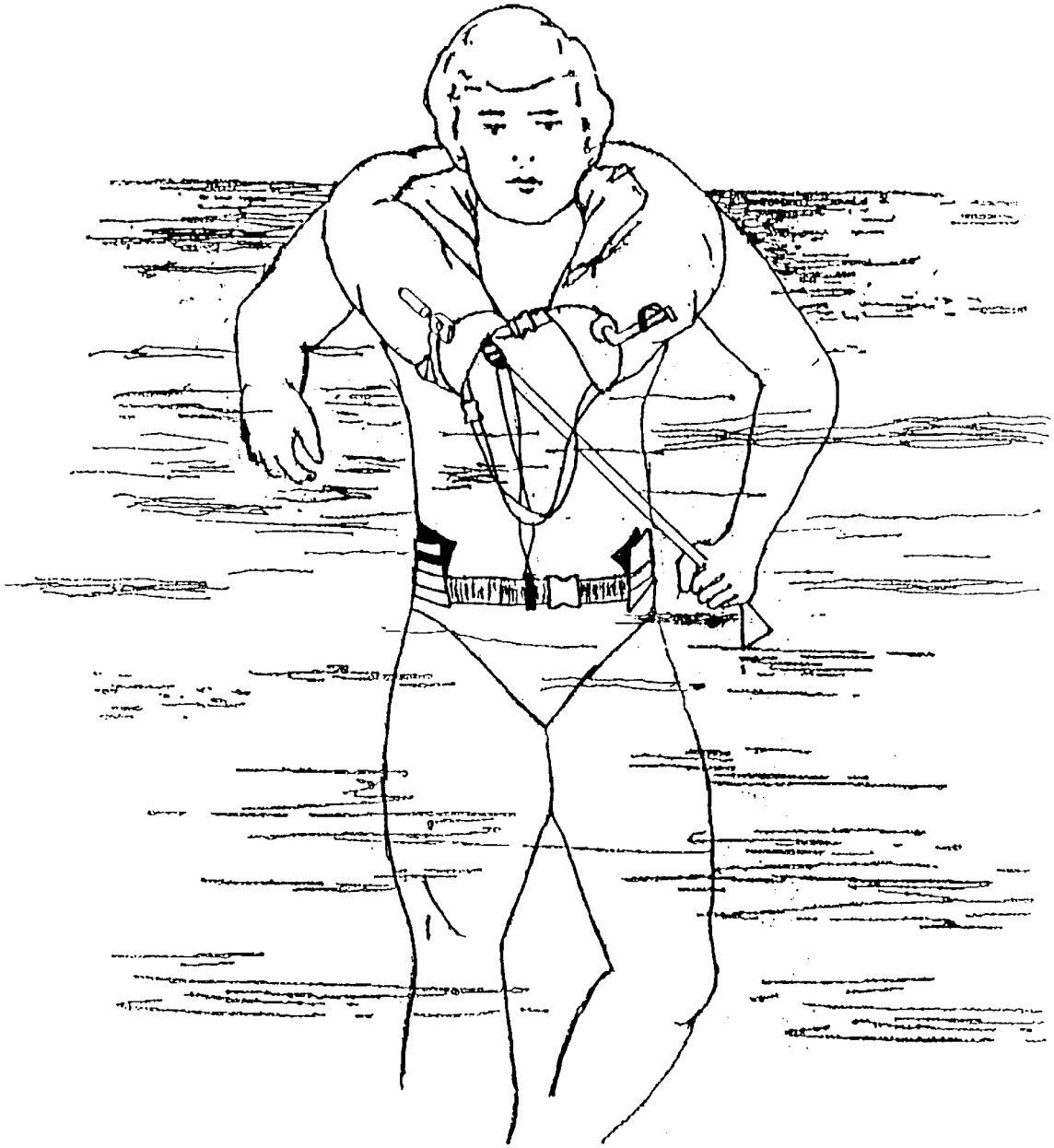
Figure 17:
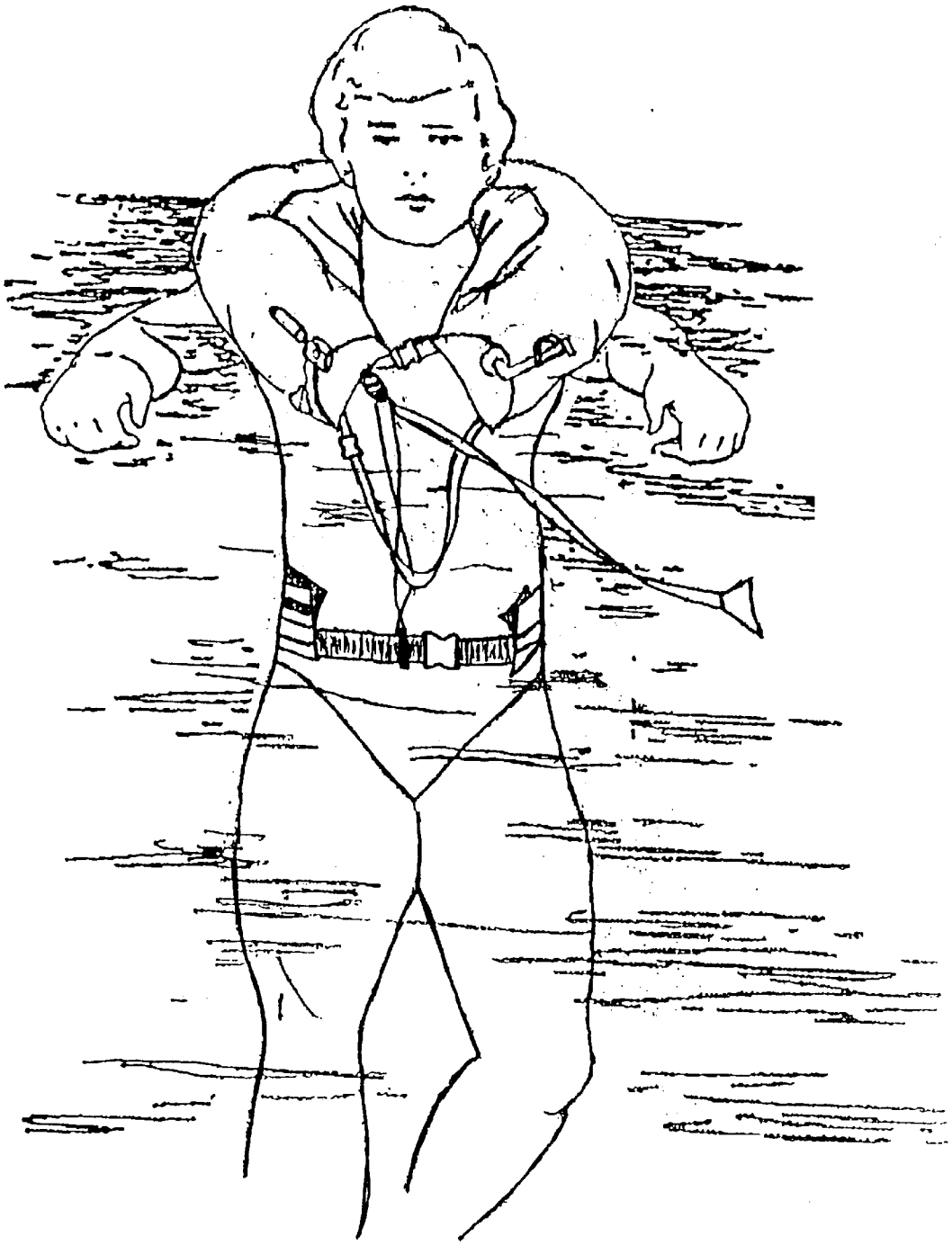
Figure 18:
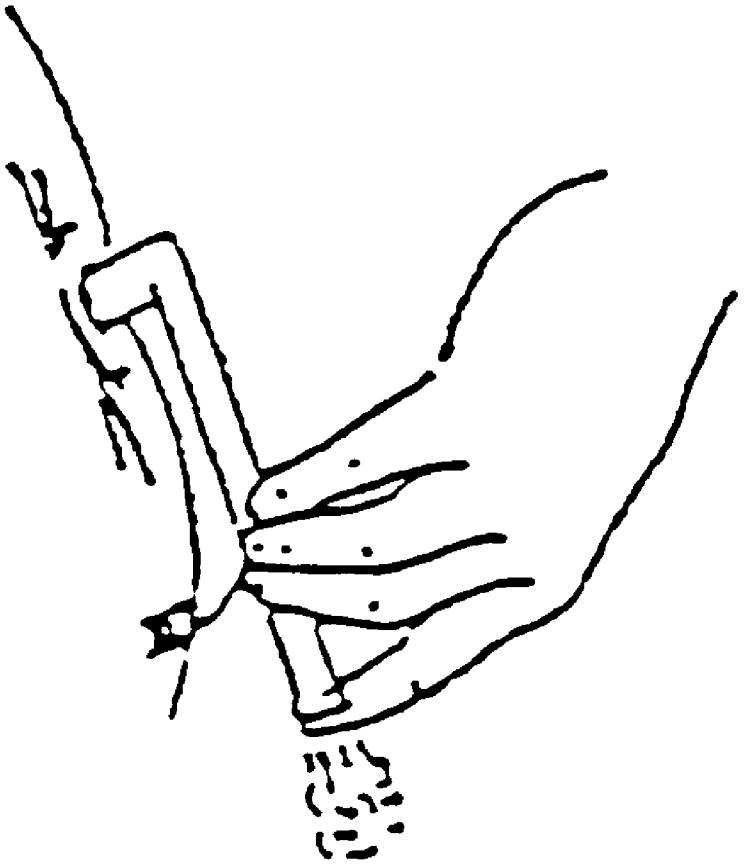
FIGS. 18–27 are illustrations helpful in an understanding of how the belt of the invention may be repacked for wearing about the waist after use.
Figure 19:
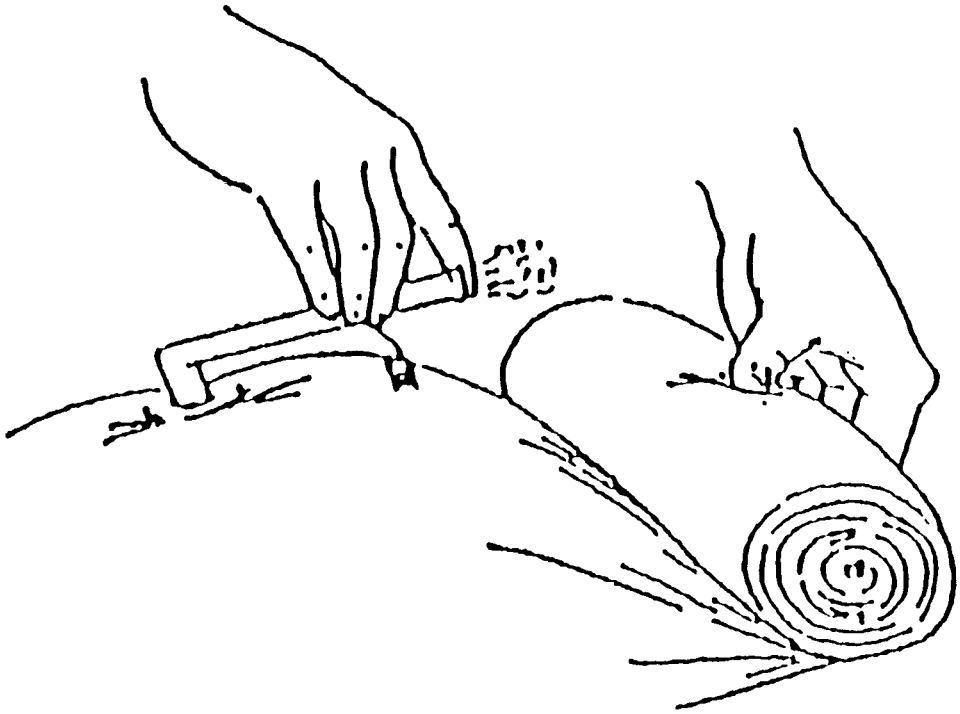
Figure 20:
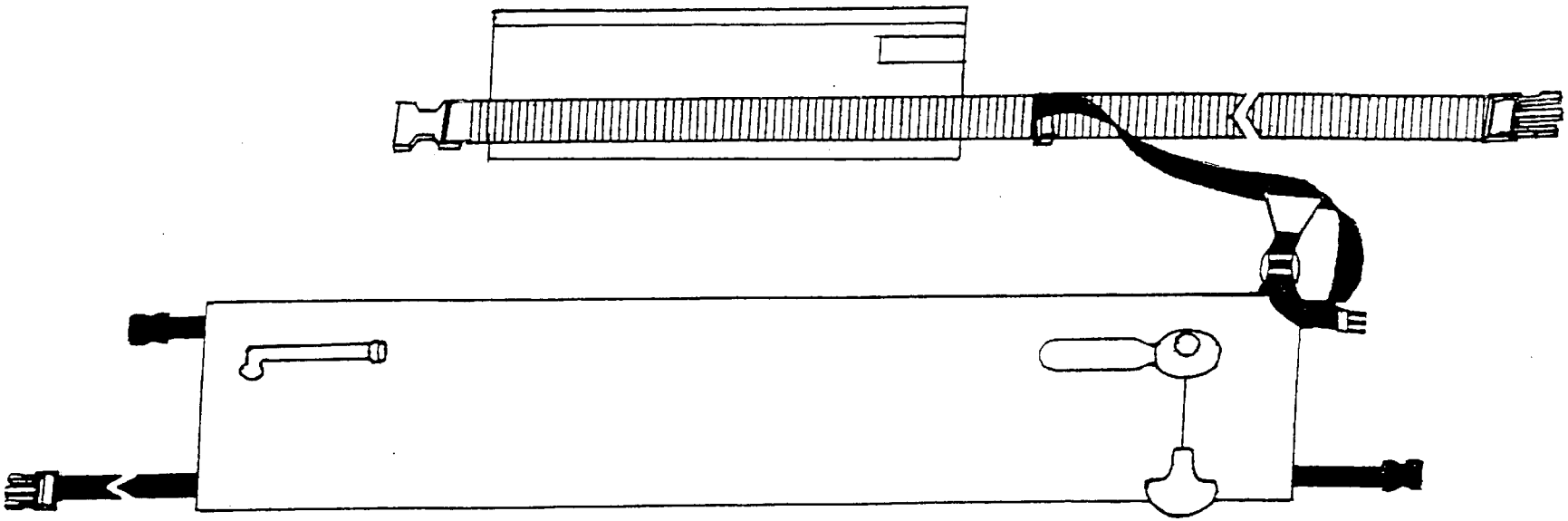
Figure 21:
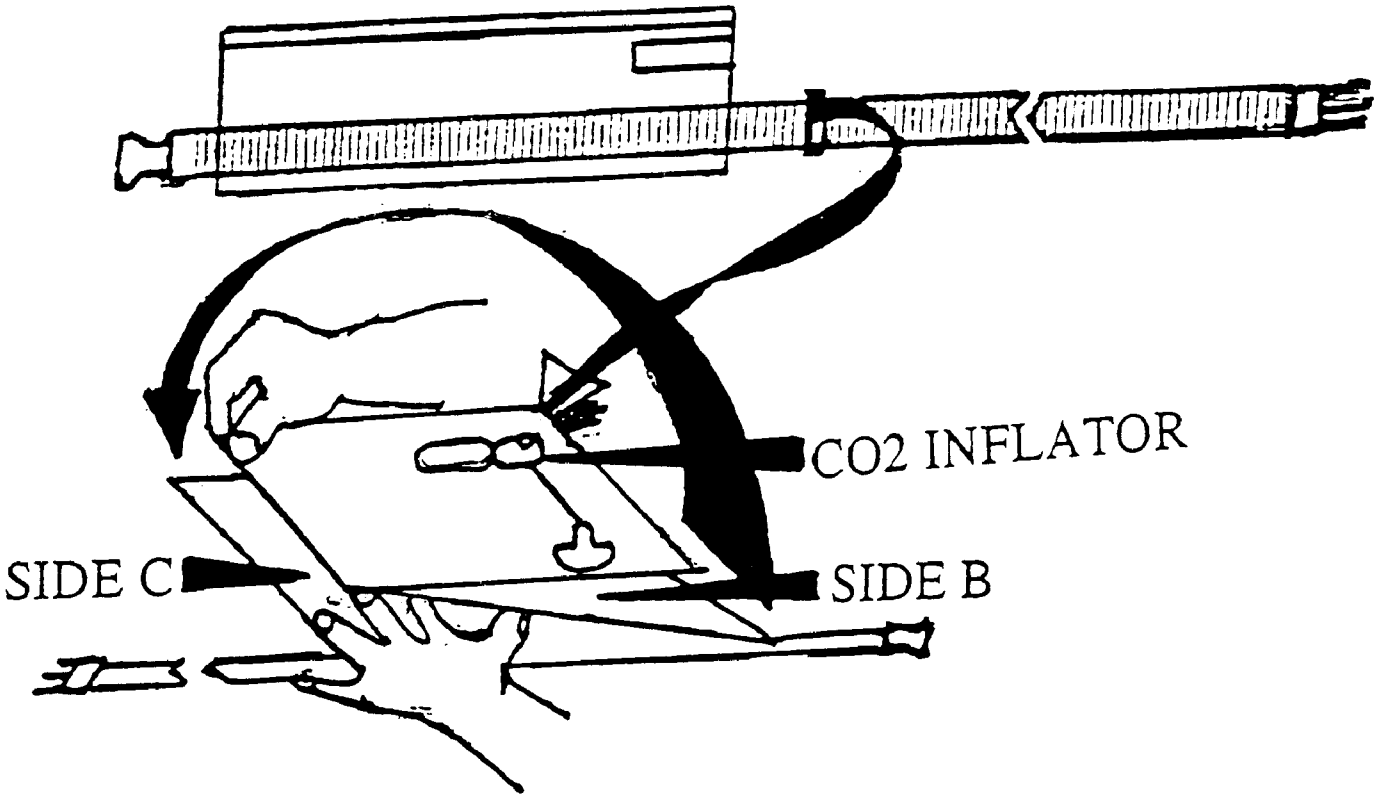
Figure 22:
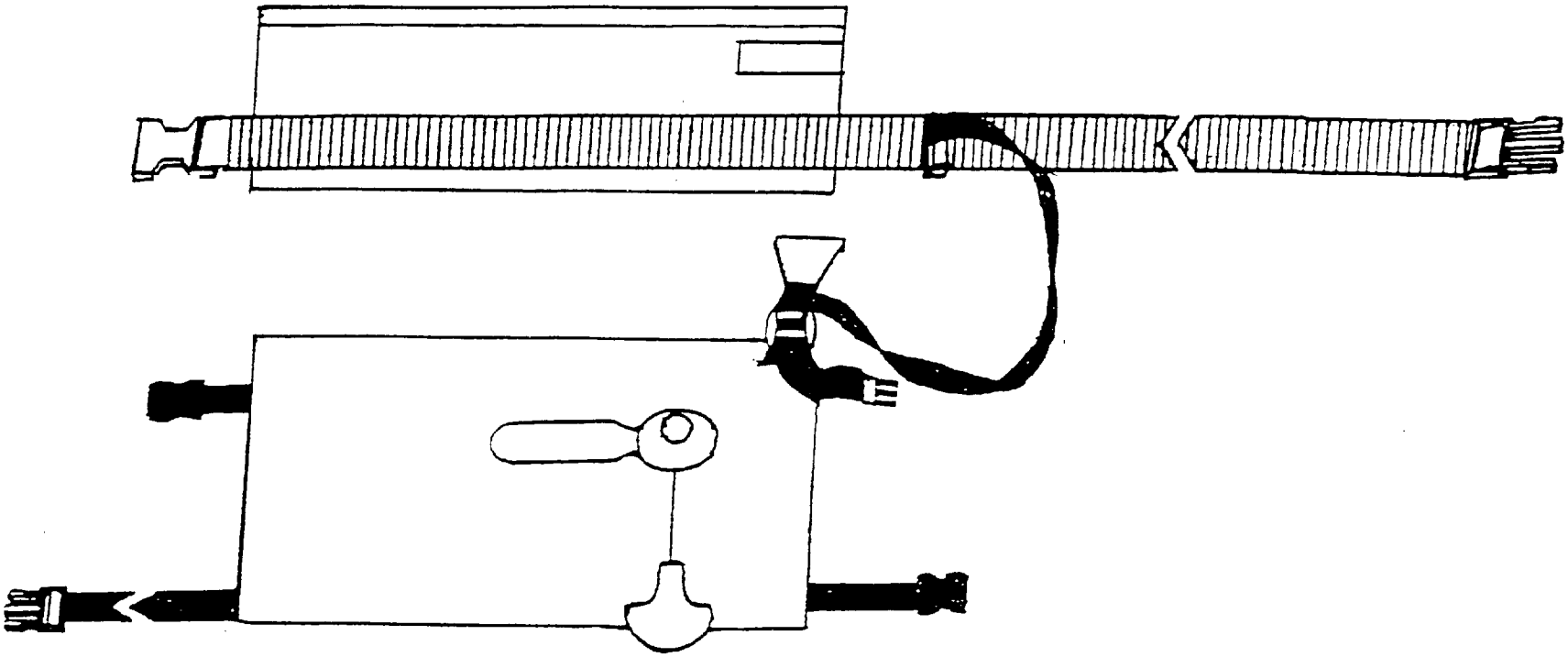
Figure 23:
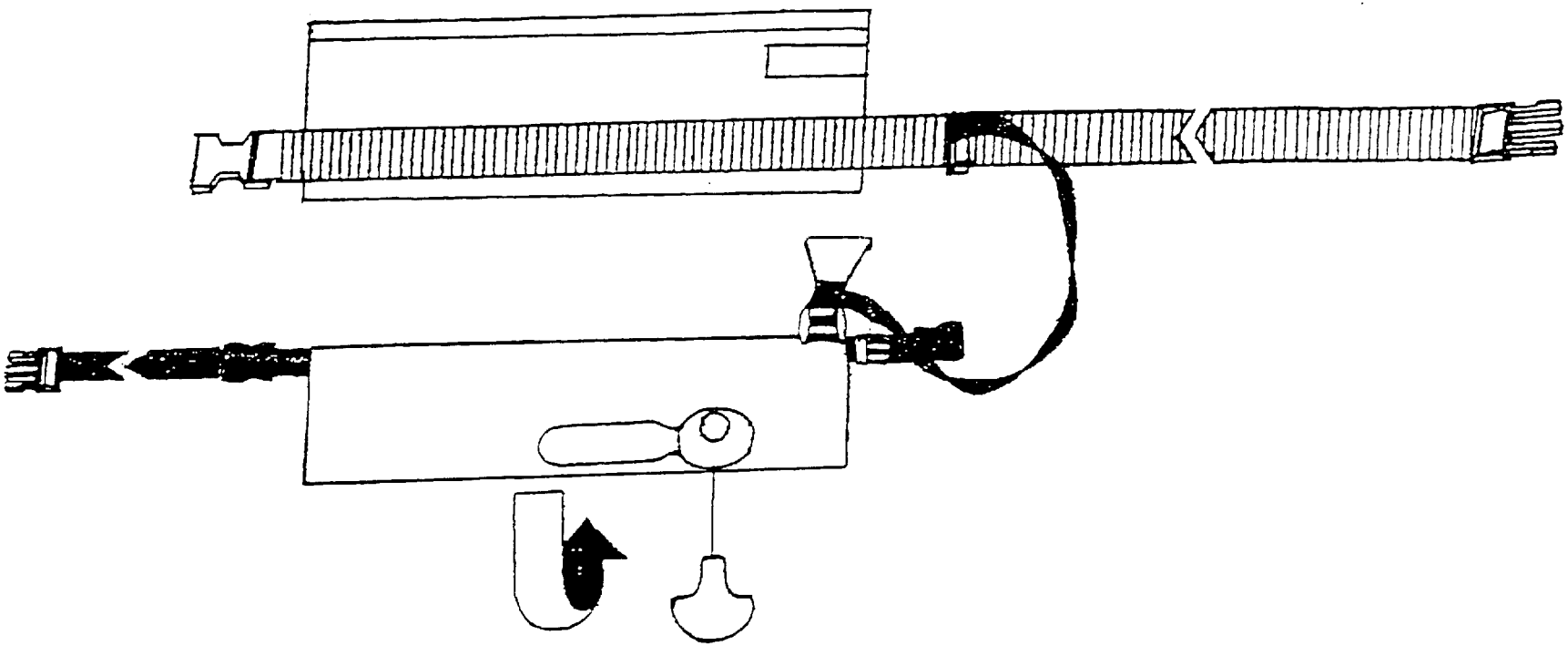

FIGS. 12–17 illustrate this manner of converting the life preserver aspect of the invention to its life vest mode. For this, the life preserver is rotated around to the back in a manner comparable to that of FIG. 10. The right arm of the wearer is then lowered down inside the life preserver to take on the form of FIG. 12. The left arm is then lowered down inside the life preserver as in FIG. 13, to the position where the life preserver is now around the wearer' neck (FIG. 14). The clasp 71A and the snap-buckle 73A are then joined together (FIG. 15) and the drawstrap 81 is pulled downwardly (FIG. 16) to be tightened into the position shown in FIG. 17. With waist belt 30A continuing to be in position, the life preserver of the inflatable swimmer's safety belt is then converted to the life vest to support an unconscious or overly tired wearer. When strength is regained, the wearer can reverse the steps in FIGS. 12–17, to begin swimming anew, until tiring later on and converting the inflatable swimmer's safety belt back to the life vest position. Maximum freedom will thus be seen to result in a life preserver position, with maximum security being attainable in the life vest position. A simplification of this process will thus be seen when comparing these steps of using the swimmer's safety belt of this invention, as compared to the matter of using the safety belt of my U.S. Pat. No. 5,702,279 design. FIGS. 18–25 are helpful in understanding how to pack the inflatable swimmer's safety belt after use. Thus, in FIG. 18, a finger pressing down on the oral inflator tube 60A deflates its valve, and the inflated belt 16 is then rolled to achieve complete deflation (FIG. 19). The empty compressed gas cartridge is unscrewed and discarded, and a newly charged cylinder is snugly screwed back into position. The waist strap 30A is then loosened, the jacket 36 laid out, the tab end 34 is pulled all the way up to the snap buckle 17A, and the belt 10A is aligned with the compressed gas cartridge 22, its actuator 61 and the lanyard 24 on the right and the with oral inflator tube 60A on the left (FIG. 20). The belt 10A is folded from left-to-right, underneath, in half (FIG. 21), and folded in half from left-to-right, underneath once again (FIG. 22), to have all sides meet exactly.

Figure 24:
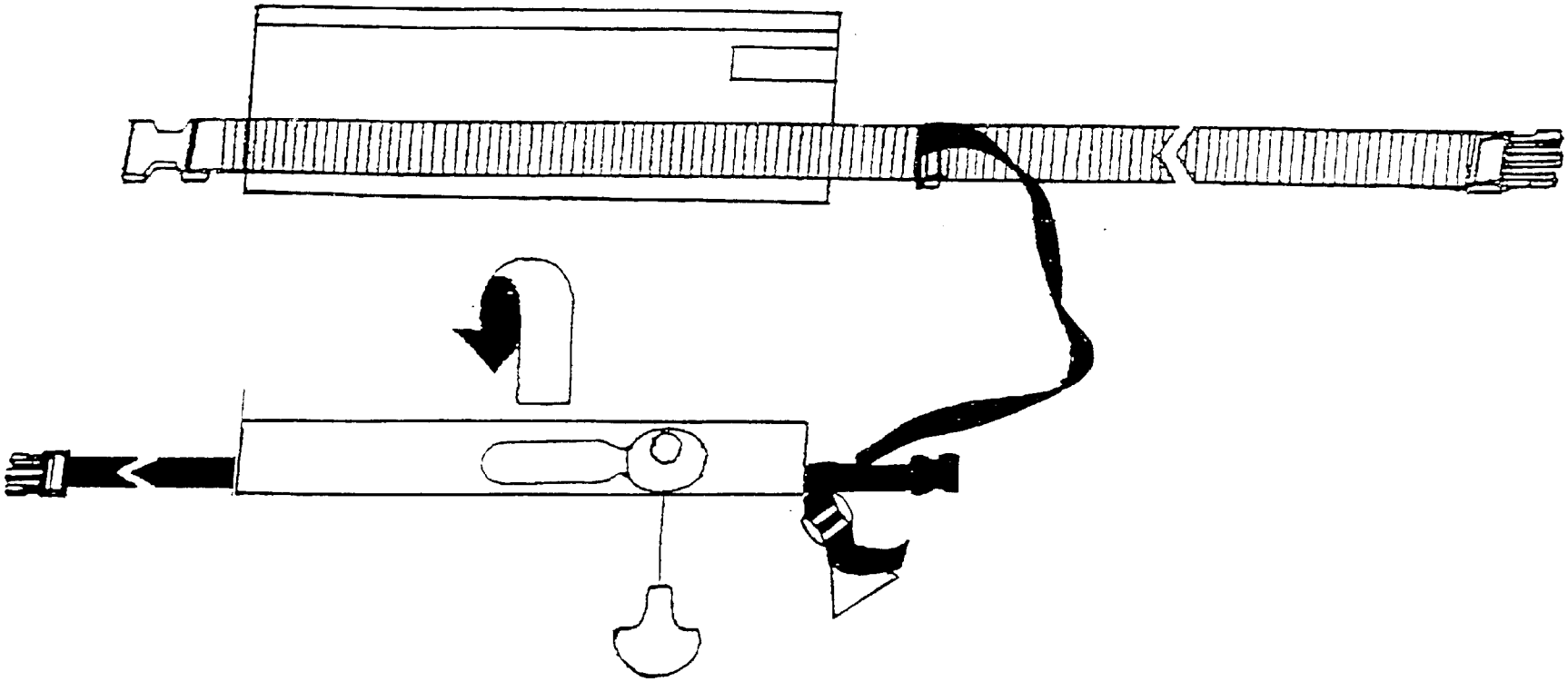
Figure 25:
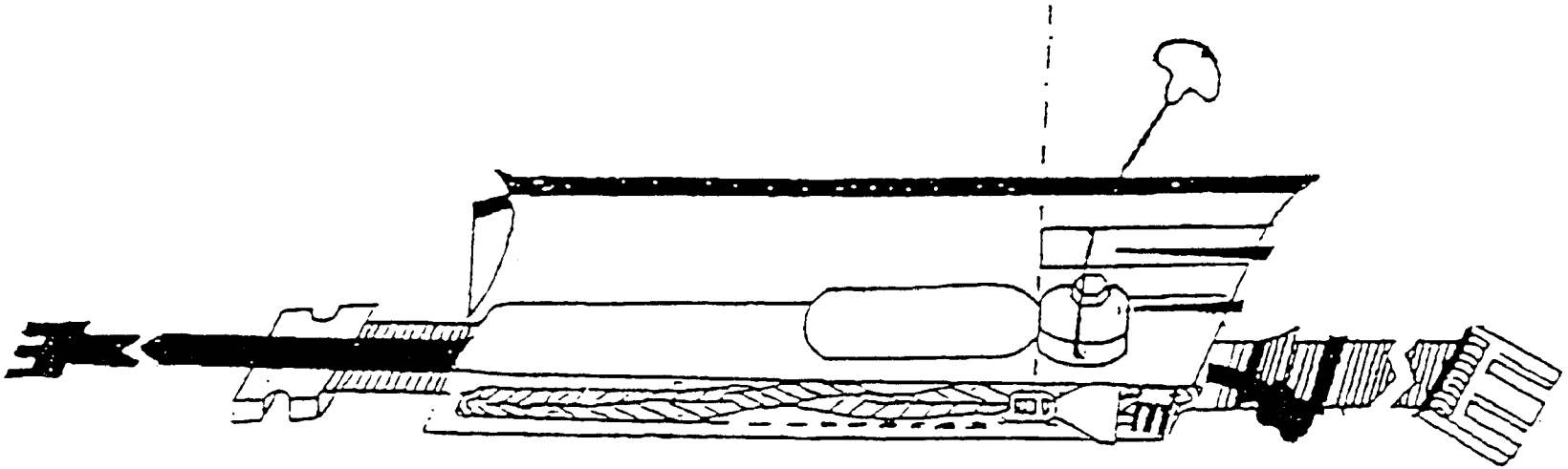
Figure 26:
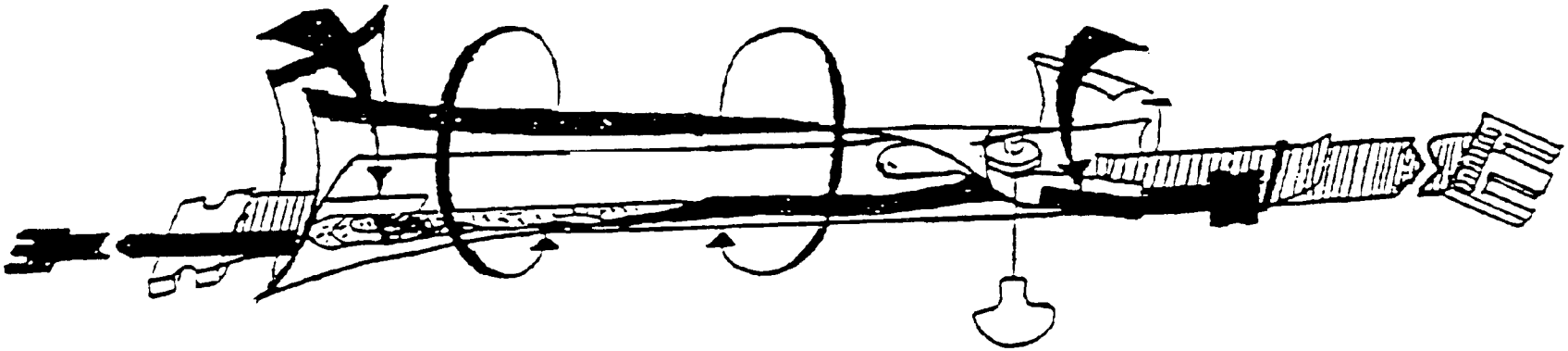
Figure 27:
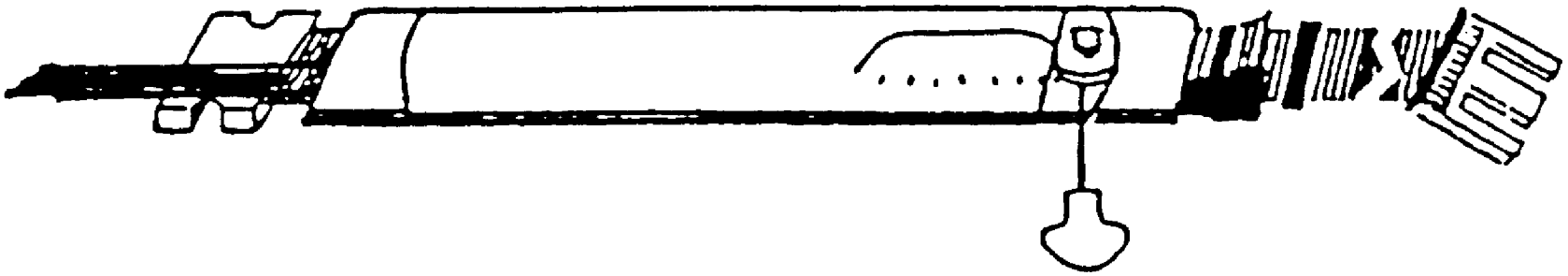

The folded belt 10A is then folded in half, once more, underneath from bottom to top (FIG. 23), and then likewise folded in half again from top to bottom (FIG. 24). Next, the jacket 36 is opened with the repacking instructions on the inside, and the folded belt 10A is set down onto the waist belt 30A, with the side A of the compressed gas actuator 61 aligned with the side B of the compressed gas actuator window 101 (FIG. 25). To start closing the jacket 36, its too long Velcro edges 42 are pulled together and the tab extension 84 is pulled through the window 101, where a Velcro flap 103 closes it over. After the Velcro edges 42 are together, a second Velcro flap 104 is closed at the left end (FIG. 26), and the closed belt is then shown in FIG. 27, with the releasable clasp 35 exposed, and with the lanyard 24 hanging downwardly, freely on the outside of the belt. As will be noted, the long, rectangular inflatable shape which results is one which is simple, not at all bulky, and one which can be worn comfortably.

As will be recognized, the unique rectangular shape of the first, inflatable belt 16 and its repacking/folding pattern allows the belt, when deflated, to be exactly and easily folded into the shape of the second, jacket belt 30—unlike the traditional curved shapes of standard inflatable airline vests and virtually all of the personal floatation devices now on the market. In this respect, it will be seen that the purpose of the second, jacket belt 30 is not only to serve as the envelope from which the first, inflatable belt 16 deploys, but as an anchor to keep the inflated life preserver and life vest from being lost in the water—by means of the pull strap 70 which is secured to the jacket belt 30.

While there have been described what are considered to be preferred embodiments of the present invention, it will be readily acknowledged by those skilled in the art that modifications can be made without departing from the scope of the teachings herein. For at least such reasons, therefore, resort should be had to the claims appended hereto for a complete understanding of the swimmer's safety belt which inflates into a life preserver for maximum freedom, or which buckles into a life vest for maximum security, with the snugness and retention of the life preserver and life vest to the waist belt 30A being afforded by the drawstrap described.

I claim:

1. A 2-step swimmer's safety belt inflatable into a life vest comprising:

a first, substantially hollow inflatable belt, closable to fit the waist of a wearer and of substantially rectangular, elongated, oblong or oval shape;

a compressed gas cartridge coupled with said first belt;

a pin, movable to puncture said cartridge so as to allow said cartridge to fill said first belt with compressed gas;

means, movable between first and second positions, and connected to said pin, for moving said pin to puncture said cartridge when moved to said second position;

wherein a portion of said first inflatable belt fitting the waist of a wearer is temporarily secured in folded, overlapping relationship so as to unfold and expand outwardly under action of the compressed gas which fills it when said means is moved to said second position to puncture said cartridge, thereby inflating said first belt and increasing the length of said first belt in forming a tube to ride upwardly towards the arm level of the wearer;

a second jacket belt, underlying said first belt, and also closable to fit about the waist of a wearer;

wherein each of said first and said second belts are closable by clasps to fit the waist of a wearer;

wherein means are provided on said first belt for maintaining the configuration of said tube formed by inflating said first belt, even when said clasp of said first belt is thereafter opened;

wherein said last mentioned means includes releasable couplings respectively provided adjacent opposite ends of said first belt;

and wherein a drawstrap of adjustable length is connected between said first and said second belts.

2. The safety belt of claim 1, further including a lock slide through which said drawstrap passes in connection between said first and said second belts.

3. The safety belt of claim 2, additionally including an extension tab on an end of said drawstrap for releasably tightening said first and second belts.

4. The safety belt of claim 1, wherein said clasp of said second belt is larger than said clasp of said first belt in fitting said first and second belts to the waist of a wearer.

5. The safety belt of claim 1, wherein said drawstrap is connected to said second belt by a box slide on said second belt.

6. The safety belt of claim 5, wherein said box slide is movable along the length of said second belt.

7. The safety belt of claim 6, wherein said second belt is closable about the waist to fit either at the front or back of the wearer and wherein said drawstrap is of a length to permit 360° rotation of said tube vertically while securing said tube to said second belt.

8. The safety belt of claim 1, also including a jacket enclosing said first inflatable belt about the waist of a wearer and in which said jacket belt encloses at least said portion of said first belt of folded, overlapping relationship.

9. The safety belt of claim 8, also including releasable clasp and snap-buckle couplings at opposite ends of said jacket belt to enclose said first inflatable belt about the waist of a wearer.

10. The safety belt of claim 3, wherein said extension tab of said drawstrap is highlighted in color.

11. The safety belt of claim 10, wherein said pin-moving means is also highlighted in color.

12. The safety belt of claim 11, wherein said extension tab and said pin-moving means are highlighted in different colors.

13. The safety belt of claim 1, wherein the rectangular, elongated, oblong or oval shape of said first inflatable belt, once deflated for repacking and re-use is configured to be folded in half and then folded again into quarters to be repacked into said second jacket belt.

14. The safety belt of claim 13, wherein said first inflatable belt is configured to compactly and exactly repack into said second jacket belt.

* * * * *